US009050840B2

(12) United States Patent
Sakamoto et al.

(10) Patent No.: US 9,050,840 B2
(45) Date of Patent: Jun. 9, 2015

(54) PRINTING APPARATUS AND METHOD FOR CORRECTING PRINTING POSITION SHIFT

(71) Applicant: CANON KABUSHIKI KAISHA, Tokyo (JP)

(72) Inventors: Atsuchi Sakamoto, Yokohama (JP); Susumu Hirosawa, Tokyo (JP); Satoshi Masuda, Yokohama (JP); Toshiki Takeuchi, Tokyo (JP); Kengo Nieda, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/471,265

(22) Filed: Aug. 28, 2014

(65) Prior Publication Data

US 2015/0062225 A1 Mar. 5, 2015

(51) Int. Cl.
*B41J 2/045* (2006.01)
*B41J 25/34* (2006.01)

(52) U.S. Cl.
CPC ..... *B41J 25/34* (2013.01); *B41J 2/04501* (2013.01)

(58) Field of Classification Search
CPC ..... B41J 2/155; B41J 29/393; B41J 2/04505; B41J 2/15; B41J 2/2146; B41J 25/005; B41J 2/145; B41J 2/2135; B41J 11/42; B41J 11/008; B41J 11/70; B41J 19/145; B41J 2002/14185; B41J 2029/3935; H01L 51/0005; G06K 15/105; G06K 2215/111
USPC ..... 347/9, 12, 14–16, 19–20, 40–43
See application file for complete search history.

(56) References Cited

U.S. PATENT DOCUMENTS

| | | | |
|---|---|---|---|
| 6,820,956 | B2 | 11/2004 | Sakamoto et al. |
| 6,921,218 | B2 | 7/2005 | Moriyama et al. |
| 6,945,623 | B2 | 9/2005 | Sakamoto et al. |
| 7,296,872 | B2 | 11/2007 | Hayashi et al. |
| 7,344,219 | B2 | 3/2008 | Sakamoto et al. |
| 7,349,122 | B2 | 3/2008 | Sakamoto et al. |
| 7,618,116 | B2 | 11/2009 | Hamasaki et al. |
| 7,706,023 | B2 | 4/2010 | Kanda et al. |
| 7,758,153 | B2 | 7/2010 | Tanaka et al. |
| 7,782,350 | B2 | 8/2010 | Tanaka et al. |
| 7,959,246 | B2 | 6/2011 | Hamasaki et al. |

(Continued)

FOREIGN PATENT DOCUMENTS

| | | | |
|---|---|---|---|
| EP | 1764996 | A1 | 3/2007 |
| EP | 2465687 | A1 | 6/2012 |

(Continued)

*Primary Examiner* — Thinh Nguyen
(74) *Attorney, Agent, or Firm* — Fitzpatrick, Cella, Harper & Scinto

(57) ABSTRACT

A printing apparatus, including: printing unit; conveying unit; print control unit; correcting unit configured to determine, in printing an image on each of a plurality of sets of the same type of print medium, a correction value for correcting printing position shift between a plurality of nozzle arrays based on an inspection pattern printed on a preceding region of the print medium, and to correct the printing position between the plurality of nozzle arrays in the subsequent region of the print medium by using the determined correction value, wherein the correcting unit corrects, in printing on a leading end region of a set of print medium subsequent to the preceding set of print medium, the printing position shift by using the correction value used in printing on the preceding set of print medium.

20 Claims, 18 Drawing Sheets

(56) References Cited

U.S. PATENT DOCUMENTS

| | | | | |
|---|---|---|---|---|
| 8,231,216 | B2 | 7/2012 | Yamamuro et al. | |
| 8,348,372 | B2 | 1/2013 | Chikuma et al. | |
| 8,384,944 | B2 | 2/2013 | Kawatoko et al. | |
| 8,444,246 | B2 | 5/2013 | Muro et al. | |
| 8,622,538 | B2 | 1/2014 | Miyakoshi et al. | |
| 8,651,614 | B2 | 2/2014 | Sakamoto et al. | |
| 8,675,250 | B2 | 3/2014 | Muro et al. | |
| 8,740,333 | B2 | 6/2014 | Teshigawara et al. | |
| 8,740,345 | B2 | 6/2014 | Masuda | |
| 8,757,754 | B2 | 6/2014 | Azuma et al. | |
| 8,864,266 | B2 | 10/2014 | Suzuki et al. | |
| 2009/0262158 | A1 | 10/2009 | Sasayama | |
| 2010/0214347 | A1 | 8/2010 | Sasayama | |
| 2011/0141213 | A1 | 6/2011 | Sakamoto et al. | |
| 2011/0234677 | A1 | 9/2011 | Tokunaga et al. | |
| 2011/0279832 | A1 | 11/2011 | Muro et al. | |
| 2011/0298849 | A1 | 12/2011 | Murayama et al. | |
| 2012/0026229 | A1 | 2/2012 | Kato et al. | |
| 2012/0038697 | A1* | 2/2012 | Snyder et al. | 347/15 |
| 2012/0050375 | A1 | 3/2012 | Kano et al. | |
| 2012/0050378 | A1 | 3/2012 | Kido | |
| 2012/0287191 | A1 | 11/2012 | Nishikori et al. | |
| 2012/0287194 | A1 | 11/2012 | Masuda et al. | |
| 2013/0002749 | A1 | 1/2013 | Masuda | |
| 2013/0093809 | A1 | 4/2013 | Kosaka et al. | |
| 2013/0335471 | A1 | 12/2013 | Murase et al. | |
| 2014/0104335 | A1 | 4/2014 | Kawatoko et al. | |
| 2014/0292863 | A1* | 10/2014 | Tanase et al. | 347/13 |

FOREIGN PATENT DOCUMENTS

| | | | |
|---|---|---|---|
| JP | 2004-330771 | A | 11/2004 |
| JP | 2007-152853 | A | 6/2007 |

* cited by examiner

FIG.8A NOZZLE-ARRAY DIRECTION

FIG.8B NOZZLE-ARRAY DIRECTION

FIG.8C NOZZLE-ARRAY DIRECTION

FIG.8D NOZZLE-ARRAY DIRECTION

PRINTING APPARATUS AND METHOD FOR CORRECTING PRINTING POSITION SHIFT

BACKGROUND OF THE INVENTION

1. Field of the Invention

The present invention relates to an inkjet printing apparatus and a method for correcting a printing position shift. More particular, the present invention relates to a method for correcting a printing position shift in an inkjet printing apparatus including a plurality of nozzle arrays that are arranged side by side and each extend in a width direction of continuous paper such as a roll of paper or a web in order to print images on the continuous paper.

2. Description of the Related Art

In the full-line type color inkjet printing apparatus, a plurality of nozzle arrays ejecting different inks are arranged at predetermined intervals in the conveying direction of a print medium. In the type of the printing apparatus, to print dots on the same position of the print medium, timing to eject ink is shifted with respect to each nozzle array. There is known a method of, in order to adjust the ink ejecting timing, adding null data which is data on no ink ejection to print data to be printed by each nozzle array, and varying the amount of addition with respect to each nozzle array.

In this case, typically, the null data is set in predetermined bit units for CPU to facilitate processing. Therefore, the interval in each nozzle array is set to allow the ink ejection timing to be adjusted, which makes it difficult to determine an interval in each nozzle array in an arbitrary manner.

Japanese Patent Laid-Open No. 2004-330771 discloses a method of changing addresses for starting reading null data in accordance with positions of the nozzle arrays while different amounts of null data are added on a nozzle array basis because the interval of each nozzle array can be set in an arbitrary manner.

Even if ink ejection timing is adjusted with the method according to Japanese Patent Laid-Open No. 2004-330771, when the speed of ink ejection is varied from nozzle array to nozzle array, the print positions of dots are shifted. To prevent this, Japanese Patent Laid-Open No. 2007-152853 discloses a printing apparatus which measures the ejection speed of ink droplets on the basis of a cumulative number of ink droplets and performs registration adjustment when a speed change is detected.

The printing apparatus uses conveying unit to convey a print medium, in which the coefficient of friction between a conveying roller which is the conveying unit and the print medium may possibly vary because a change in surface state caused by adhesion of paper powder to the surface of the conveying roller, the moisture contents of the print medium, environmental conditions in the printing apparatus and the like. This may possibly change the amount of conveying the print medium. A change in the amount of conveyance when an image is printed on the continuous paper may occur, for example, when the print medium cut after a continuous image has been printed on it is given as one set, at the start of printing on each of a plurality of sets to be output or during the process of printing the continuous image. In this manner, if the amount of conveyance of the print medium per unit time is changed, print positions shift between print heads.

In the construction in Japanese Patent Laid-Open No. 2004-330771, an address to start reading print data is fixedly determined on a nozzle array basis with reference to the position of the nozzle array. Because of this, when the amount of conveyance of the print medium per unit time is varied by conditions of the conveying unit and the print medium, appropriate adjustment for ink ejection timing is difficult to be performed.

Further in the construction of Japanese Patent Laid-Open No. 2007-152853, since registration adjustment is performed at the timing when a change in ink ejection speed is detected, when the amount of conveyance of the print medium per unit time is varied by conditions of the conveying unit and the print medium, the printing position shift is difficult to be addressed.

SUMMARY OF THE INVENTION

The present invention provides an inkjet printing apparatus and a method for correcting a printing position shift, capable of suppressing the printing position shift when the amount of conveyance of a print medium per unit time is varied at output of a plurality of sets of print mediums with images printed on.

According to a first aspect of the present invention, there is provided a printing apparatus, including:

printing unit including a plurality of nozzle arrays with a plurality of nozzles for ejecting ink arranged therein in a predetermined direction, the plurality of nozzle arrays being arranged in a direction intersecting with the predetermined direction;

conveying unit configured to feed and convey a print medium in a conveying direction intersecting with the predetermined direction;

print control unit configured to control the printing unit to use the plurality of nozzle arrays to print an image on the print medium conveyed by the conveying unit, and to cut the print medium with an image printed thereon from the print medium to output the cut print medium as one set;

correcting unit configured to determine, in printing an image on each of a plurality of sets of the same type of print medium, a correction value for correcting printing position shift between the plurality of nozzle arrays based on an inspection pattern printed on a preceding region of the print medium, and to correct the printing position between the plurality of nozzle arrays in the subsequent region of the print medium by using the determined correction value, wherein the correcting unit corrects, in printing on a leading end region of a set of print medium subsequent to the preceding set of print medium, the printing position shift by using the correction value used in printing on the preceding set of print medium.

According to a second aspect of the present invention, there is provided a method for correcting the printing position shift in a printing apparatus which has printing unit including a plurality of nozzle arrays with a plurality of nozzles for ejecting ink arranged therein in a predetermined direction, the plurality of nozzle arrays being arranged in a direction intersecting with the predetermined direction, conveying unit configured to feed and convey a print medium in a conveying direction intersecting with the predetermined direction, the method for correcting the printing position shift including the steps of:

controlling the printing unit to use the plurality of nozzle arrays to print an image on the print medium conveyed by the conveying unit, and to cut the print medium with an image printed thereon from the print medium to output the cut print medium as one set;

correcting printing position shift, to determine, in printing an image on each of a plurality of sets of the same type of print medium, a correction value for correcting printing position shift between the plurality of nozzle arrays based on an inspection pattern printed on a preceding region of the print medium, and to correct the printing position between the plurality of nozzle arrays in the subsequent region of the print medium by using the determined correction value, wherein in the step of correcting, in printing on a leading end region of a set of print medium subsequent to the preceding set of print medium, the printing position shift is corrected, by using the correction value used in printing on the preceding set of print medium.

With the construction, the printing position shift is corrected by use of a correction value for correcting the printing position shift occurring in a preceding region, in regions subsequent to a leading end region of a set. In the leading end region, a correction value in the preceding set is used to correct the printing position shift. As a result, the printing position shift in each region of a set can be appropriately corrected. Accordingly, for outputting a plurality sets of the print medium with images printed on, the printing position shift produced when the amount of conveyance of the print medium per unit time is varied can be suppressed.

Further features of the present invention will become apparent from the following description of exemplary embodiments (with reference to the attached drawings).

DESCRIPTION OF THE EMBODIMENTS

Hereinafter, an exemplary embodiment according to the present invention will be in detail described with reference to the accompanying drawings.

Figure 1:
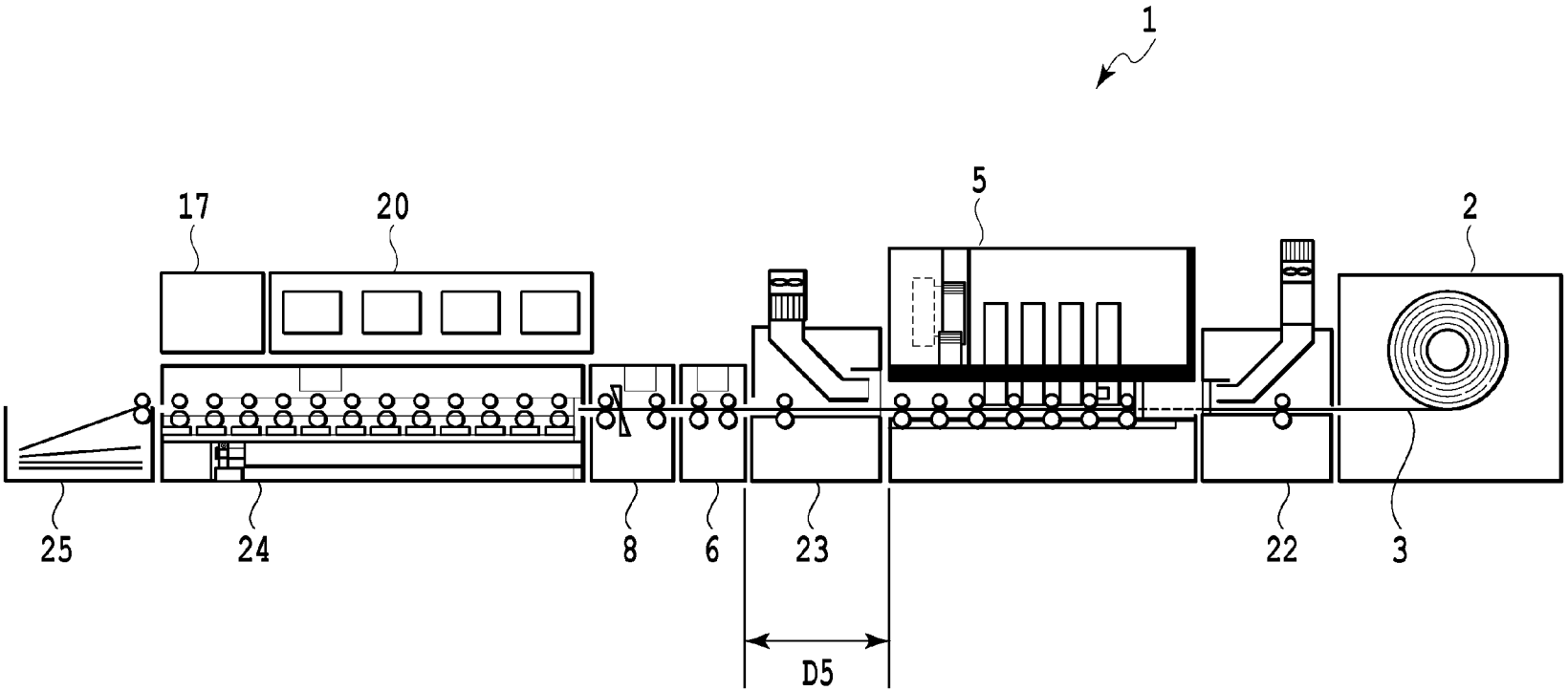
FIG. 1 is a sectional view illustrating the interior structure of an inkjet printing apparatus.

FIG. 1 is a sectional view illustrating the interior structure of an inkjet printing apparatus 1 (hereinafter, referred to as a "printing apparatus 1") according to the present embodiment. As illustrated in FIG. 1, the printing apparatus 1 includes a paper feeder 2, a supply unit 22, a printing unit 5, a collection unit 23, an inspection unit 6, a cutting unit 8, a drying unit 24, a discharging unit 25, an ink tank 20, and a controller 17.

As will be described later in detail with reference to FIG. 2, a print medium 3 supplied from the paper feeder 2 is conveyed to the printing unit 5. After an image or the like is printed on the print medium 3 by the printing unit 5, a result of the printing is inspected by the inspection unit 6, and then the print medium 3 is cut into a predetermined size by the cutting unit 8. The print medium 3 thus cut and separated is conveyed to the drying unit 24 equipped with a heater 21 to be dried by the drying unit 21, and then is placed in the discharging unit 25.

The supply unit 22 supplies moisturized gas into the printing unit 5 to prevent evaporation and drying of ink located in an nozzle in a print head of the printing unit 5. The moisturized gas supplied from the supply unit 22 is collected by the collection unit 23. The collected gas may be returned to the supply unit 22 through a return duct (not shown) for circulation.

Figure 2:
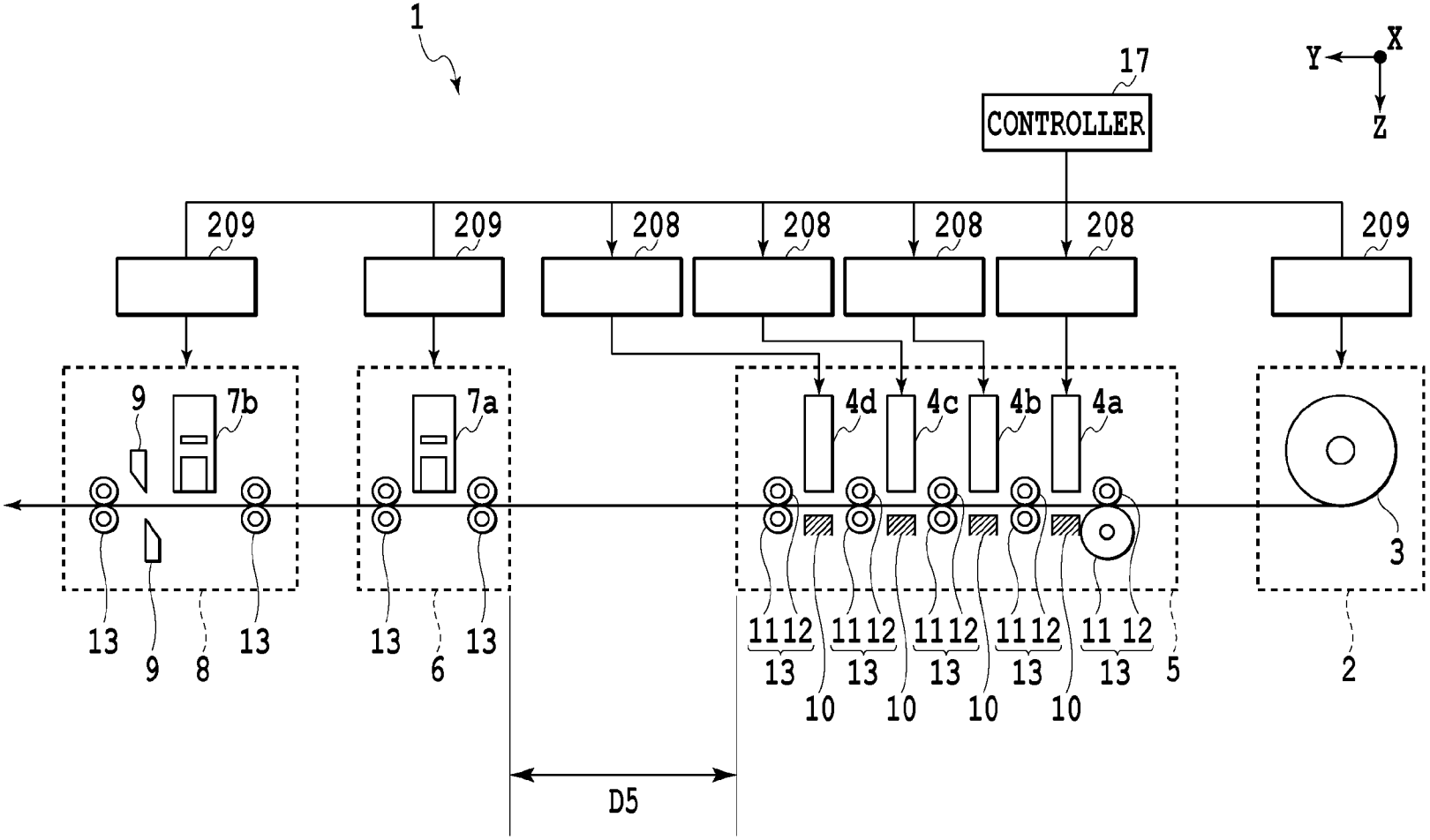
FIG. 2 is a sectional view illustrating the interior structure of the inkjet printing apparatus.

FIG. 2 is a sectional view illustrating the interior structure of the printing apparatus 1, from which the supply unit 22, the collection unit 23, the ink tank 20, the drying unit 24 and the discharging unit 25 shown in FIG. 1 are omitted in illustration. As illustrated in FIG. 2, the paper feeder 2 pulls the print medium 3 held in a roll form from the roll to convey the print medium 3 to the printing unit 5 which is located downstream of the paper feeder 2 in a conveying direction (y direction in FIG. 2).

The printing unit 5 prints an image on the print medium 3 conveyed from the paper feeder 2 based on an image data from a host apparatus 16 described later with reference to FIG. 4. The printing unit 5 prints a various kinds of patterns irrelevant to an output image on a non-print region between continuous print regions of the print medium 3. The patterns include a maintenance pattern, an inspection pattern and the like.

The maintenance pattern is printed for detecting the amount of a shift between print positions that is caused by a distance between a print head and the print medium, an ejection speed of an ink droplet ejected from a nozzle of a print head, a distance between print heads, and the like (referred to as a "first cause" in the specification). The inspection pattern is printed for detecting the amount of the shift between print positions that is caused by a variation in the amount of convey of the print medium per unit time and the like (referred to as a "second cause" in the specification). The printing unit 5 prints also a cut mark pattern acting as a sign for cutting the print medium 3 into a predetermined size, and the like.

The printing unit 5 includes print heads 4*a* to 4*d* that eject inks of different colors. In each of the print heads 4*a* to 4*d*, nozzle arrays are arranged along the width direction of the print medium 3. A plurality of nozzle arrays are arranged in the conveying direction of the print medium 3. Each nozzle array is composed of a plurality of nozzles. An image or the like is printed on the print medium 3 by ejecting ink from the plurality of nozzles. The print heads 4*a* to 4*d* will be described later in detail.

The printing unit 5 is provided with a conveying mechanism for conveying the print medium 3. The conveying mechanism includes a plurality of conveying roller pairs 13 each composed of a conveying roller 11 and a pinch roller 12. A platen 10 is placed between one conveying roller 13 and another conveying roller 13 and has a support face located on the opposite side from the print surface of the print medium 3 to support the print medium 3. The inspection unit 6 and the cutting unit 8 include a similar conveying mechanism. The conveying mechanism, platens 10, and the print heads 4*a* to 4*d* are housed in the housing.

The inspection unit 6 has a scanner 7*a* to cause the scanner 7*a* to read the image and various patterns which have been printed by the printing unit 5. The read information is sent to the controller 17 so that the controller 17 inspects the ejection conditions of the nozzles of the print heads 4*a* to 4*d*, the conveying conditions of the print medium 3, the print positions and the like.

The scanner 7*a* includes a light emission unit and an image pickup device which are not shown herein. The light emission unit is mounted in a position to emit light toward the reading direction of the scanner 7*a* or in a position to emit light toward the scanner 7*a*.

In the former, the image pickup device receives the reflected light of the light emitted from the light emission unit. In the later, the image pickup device receives a light traveling through the print medium 3, of the light emitted from the light emission unit. The image pickup device converts the received light into electrical signals for output. A CCD (Charge Coupled Devices) image sensor, a CMOS (Complementary Metal Oxide Semiconductor) image sensor or the like can be used as the image pickup device.

Figure 18A:
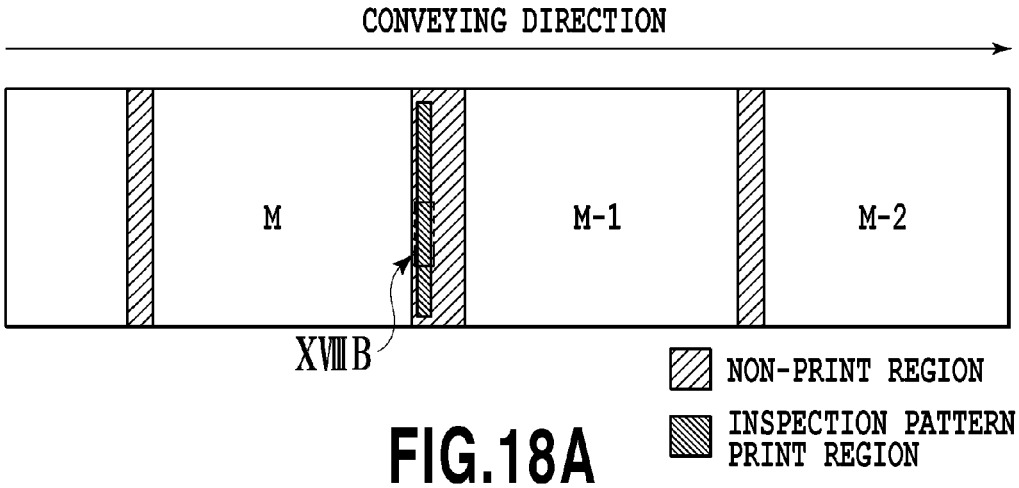
FIG. 18A is a schematic diagram showing a non-image region between image regions.
Figure 18B:
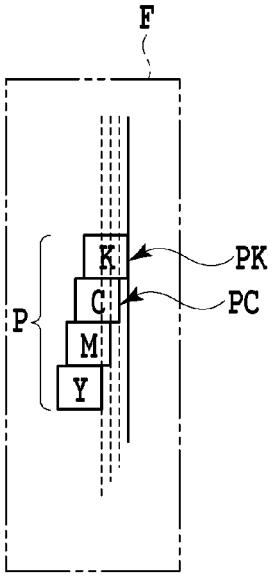
FIG. 18B is a schematic diagram showing an inspection pattern.

FIG. 18A is a schematic diagram showing a non-image region between image regions. FIG. 18B is a schematic diagram showing an inspection pattern. In the present embodiment, as illustrated in FIGS. 18A and 18B, the printing unit 5 prints an inspection pattern P on a non-print region between continuous print regions of the print medium 3 which is conveyed in a conveying direction (direction identified by an arrow in FIG. 18A). In FIG. 18A, a print head inspection pattern is printed between an image M and an image M−1. The inspection unit 6 reads and analyzes the inspection pattern P to measure the amount of a printing position shift between the nozzle arrays provided in each of the print heads 4*a* to 4*d*. The measurement result is fed back to the CPU 201 described later in order to appropriately correct print starting positions of the print heads 4*a*, 4*b*, 4*c*, 4*d* to start printing the print data, thereby enabling a correction for the printing position shift between the nozzle arrays. F represents a portion of the inspection pattern print region. The distance between the patches printed by each color head in a conveying direction is determined from the result obtained by reading the inspection pattern P with the inspection unit 6. For example, the amount of shift between printing position of a cyan nozzle array and printing position of a black nozzle array is obtained from the distance between a patch PK printed by the black nozzle array and a patch PC printed by the cyan nozzle array.

In the present embodiment, a non-print region corresponding to distance D5 illustrated in FIG. 1 and FIG. 2 exists between the portion with the inspection pattern printed on, and the subsequent image region.

The cutting unit 8 has a scanner 7*b* identical in structure with the aforementioned scanner 7*a*, and a pair of cutting mechanisms 9 for cutting the print medium 3. The scanner 7*b* checks a cutting position by reading the cut mark pattern printed on the print medium 3 by the printing unit 5, and then the print medium 3 is held between the cutting mechanisms 9 to be cut.

Then, the print medium 3 is conveyed to the drying unit 24 illustrated in FIG. 1 so as to dry the ink printed on the print medium 3. The drying unit 24 dries the ink printed on the print medium 3 by use of a technique of applying hot air to the print medium 3, a technique of applying an electromagnetic wave (ultraviolet rays or infrared rays) to the print medium 3, or the like. Then, the print medium 3 that has been dried in the drying unit 24 is discharged to the discharging unit 25 illustrated in FIG. 1.

In this manner, the conveying, printing, inspecting, cutting, drying and discharging processes are performed on the print medium 3 so as to offer an output product with an image printed on. The above-mentioned operations are controlled by a controller 17 described later.

Figure 3A:
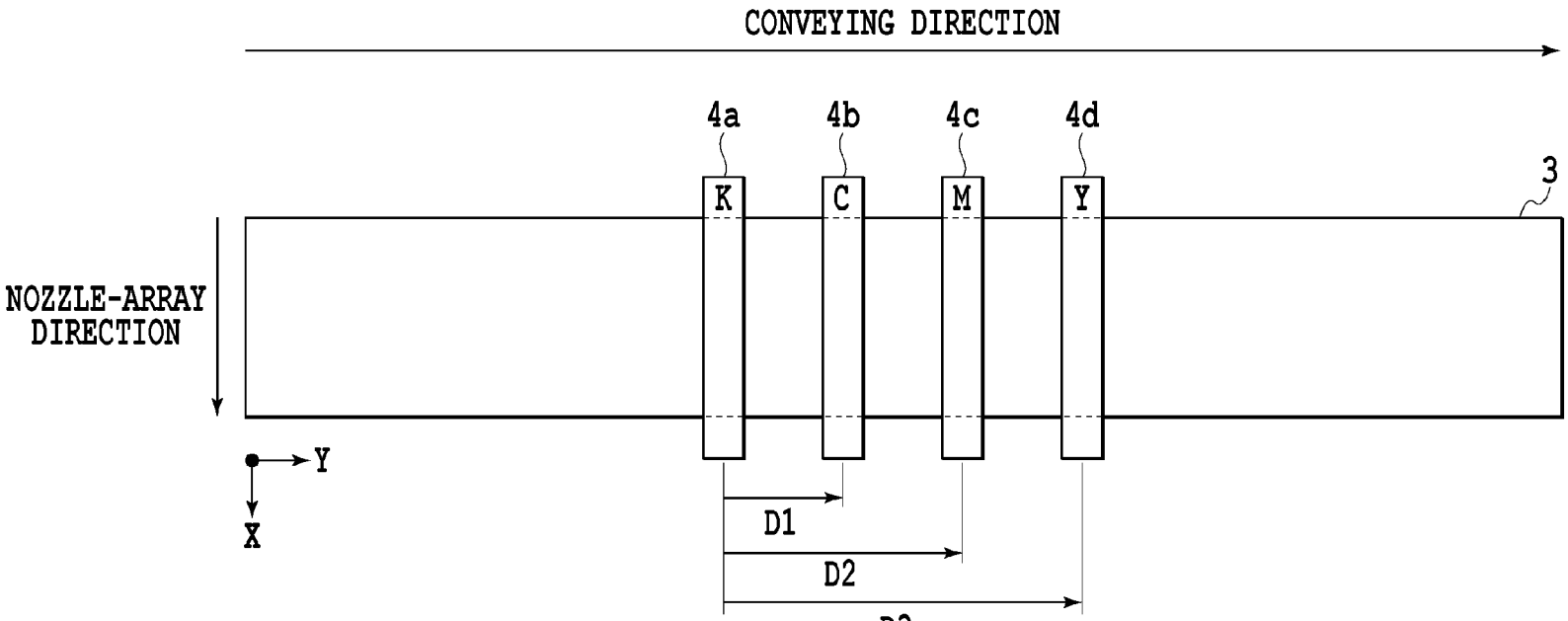
FIG. 3A is a schematic diagram illustrating the relative-movement relationship between print heads and a print medium.

Next, the print heads 4*a* to 4*d* will be described. FIG. 3A is a schematic diagram illustrating the relative-movement relationship between the print heads 4*a* to 4*d* and the print medium 3, which is a top view illustrating an area around the printing unit 5 in FIG. 2. The printing apparatus 1 includes full-line type print heads 4*a* to 4*d* each placed to extend across the full width of the print medium 3. As illustrated in FIG. 3A, the print heads 4*a* to 4*d* are arranged in the direction of conveying the print medium 3 in the order of the print head 4*a*, the print head 4*b*, the print head 4*c* and the print head 4*d* from an upstream side in the conveying direction. An image is printed on the print medium 3 in the arrangement order of the print heads 4*a* to 4*d*.

Figure 3B:
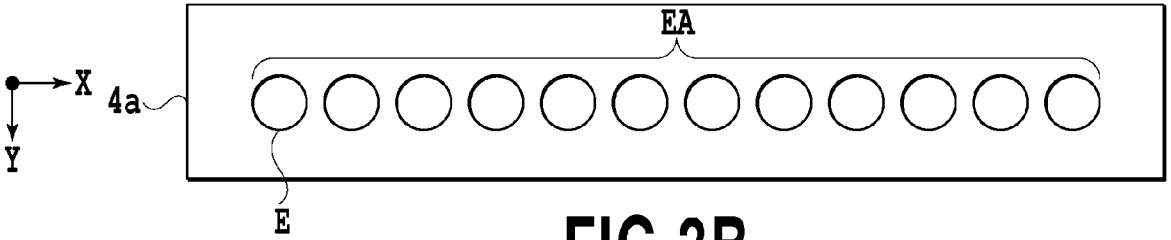
FIG. 3B is a schematic diagram illustrating a nozzle array of the print head.

FIG. 3B is a schematic diagram illustrating a nozzle array of the print head. As illustrated in FIG. 3B, Nozzle array EA composed of a plurality of nozzles E is mounted on the face of the print head 4*a* facing the print medium 3. The print heads 4*b* to 4*d* have nozzle arrays which are not shown. Each of the nozzle arrays has a plurality of nozzles arranged along the main scanning direction perpendicular to the direction of conveying the print medium 3. In the present embodiment, a printing device includes the nozzles, a channel communicating with the nozzles and an ejection energy generation element.

The ink ejection method can be used, for example, a method using a heater element, a method using piezoelectric elements, a method using electrostatic elements, or a method using MEMS (Micro Electro Mechanical System) elements, at other than a method using heating resistors elements. As illustrated in FIG. 3B, in the present embodiment, the nozzles forming a nozzle array are arranged in a line throughout the range corresponding to the width of the print medium 3 in the main scanning direction. But, the nozzles forming a nozzle array may be arranged in a staggered arrangement.

The ink tank 20 illustrated in FIG. 1 is connected to the print heads 4*a* to 4*d* so that corresponding inks can be supplied respectively to the print heads 4*a* to 4*d*. Each individual print head 4*a*, 4*b*, 4*c*, 4*d* receives a supply of the corresponding ink through an ink tube (not shown) from the ink tank 20.

The nozzles of the print head 4*a* eject a black ink (K), the nozzles of the print head 4*b* eject a cyan ink (C), the nozzle of the print head 4*c* eject a magenta ink, and the nozzles of the print head 4*d* eject a yellow ink.

In the present embodiment the four print heads 4*a* to 4*d* are provided for inks of four KCMY colors, but the number of ink colors and the number of print heads are not limited to four. In the present embodiment the length of each of the print heads 4*a* to 4*d* in the main scanning direction is 12 inches in width. However, the length of the print head in the main scanning direction, usable in the present invention, is not limited to this.

Distances D1 to D3 in FIG. 3 each represent the amount of a shift between print positions on the print medium 3 between the nozzle arrays of the respective print heads (distance between dots) when ink is ejected with the same timing. The printing position shift between nozzle arrays is caused under the influence of, not only the interval between nozzle arrays in the print heads 4*a* to 4*d*, but also the first cause, such as ejection angles of the print heads, ejection speeds, the distance between the print head and the print medium, and the like.

In the present embodiment, accordingly, the amount of the shift between print positions caused by the first cause is determined by printing and detecting the maintenance pattern. As will be described later with reference to FIGS. 15A, 15B, in actual printing on the print medium 3, timings for ejecting ink are adjusted according to reading result of the maintenance pattern.

Figure 4:
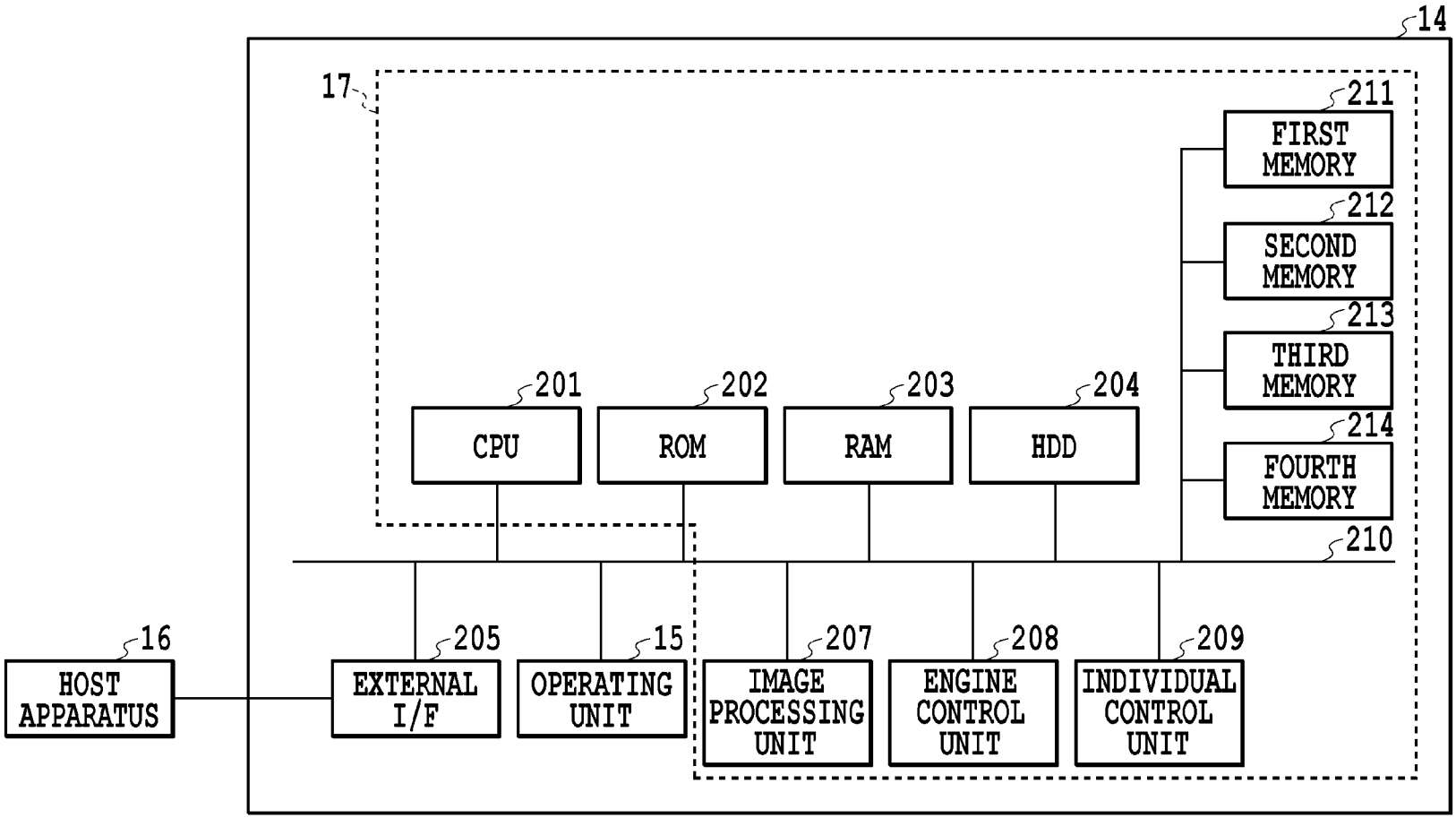
FIG. 4 is a block diagram illustrating the control system of the inkjet printing apparatus.

FIG. 4 is a block diagram illustrating the control system of the printing apparatus 1. As illustrated in FIG. 4, a control unit 14 is connected to the host apparatus 16 via an external interface 205. The control unit 14 includes the controller 17 and an operating unit 15 in addition to the external interface 205. The controller 17 controls the operation of the paper feeder 2, printing unit 5, inspection unit 6, cutting unit 8, conveying mechanism and the like through an engine control unit 208 and an individual control unit 209.

In short, the controller 17 performs various kinds of control. As shown in FIG. 4, the controller 17 includes a CPU 201, ROM 202, RAM 203, HDD 204, image processing unit 207, engine control unit 208, individual control unit 209, and a first memory 211 to a fourth memory 214.

For integrated control for operation of various components, the CPU 201 executes various programs. The ROM 202 stores various programs to be executed by the CPU 201 and fixed data desired for operation of various components in the printing apparatus 1. The RAM 203 is used as a work area for the CPU 201 and a temporary storage area to store various kinds of received data. The RAM 203 also stores various kinds of setting data. HDD 204 stores various kinds of programs, print data and various kinds of setting information desired for operation of various components of the printing apparatus 1. The first to fourth memories 211 to 214 store correction values described later with reference to FIGS. 15A, 15B.

The image processing unit 207 performs image processing on image data received from the host apparatus 16 to generate print data to be printed by use of the print heads 4*a* to 4*d*. Specifically, the image processing unit 207 performs color conversion processing and quantization processing on the received image data. Also the image processing unit 207 performs resolution conversion, image analysis, image correction and the like as necessary. The print data obtained through the steps of the image processing is stored in RAM 203 or the HDD 204.

The engine control unit 208 controls, based on control commands received from the CPU 201 and the like, driving of the print heads 4*a* to 4*d* of the printing unit 5 according to the print data. The engine control unit 208 also controls operation of the conveying mechanism and the like. The individual control unit 209 is a sub-controller to drive the paper feeder 2, the inspection unit 6, the cutting unit 8, the drying unit and the discharging unit, based on control commands received from the CPU 201.

The operating unit 15 is an input/output interface to the user, which includes an input unit and an output unit. The input unit includes hard keys, a touch panel and the like to receive instructions from the user. The output unit includes a display, a speech generation device and the like to display or utter information for conveyance of information to the user. The external interface 205 is provided for connection of the controller 17 to the host apparatus 16. The above configuration components are connected through a system bus 210.

The host apparatus 16 is a source of image data. The printing apparatus 1 prints an image to the print medium 3 to obtain an output product on the basis of the image data supplied from the host apparatus 16. The host apparatus 16 may be either a general-purpose apparatus, such as a computer, or a dedicated image apparatus, such as an image capture apparatus having an image reader, a digital camera or a photo storage device.

In the case of the host apparatus 16 being a computer, an operating system, application software and a printer driver for the printing apparatus 1 should be installed in the storage device of the computer. It should be noted that not all of the processes described above need be performed by software, and that one or all of the processes may be provided by hardware.

<Print Data>

Figure 5:
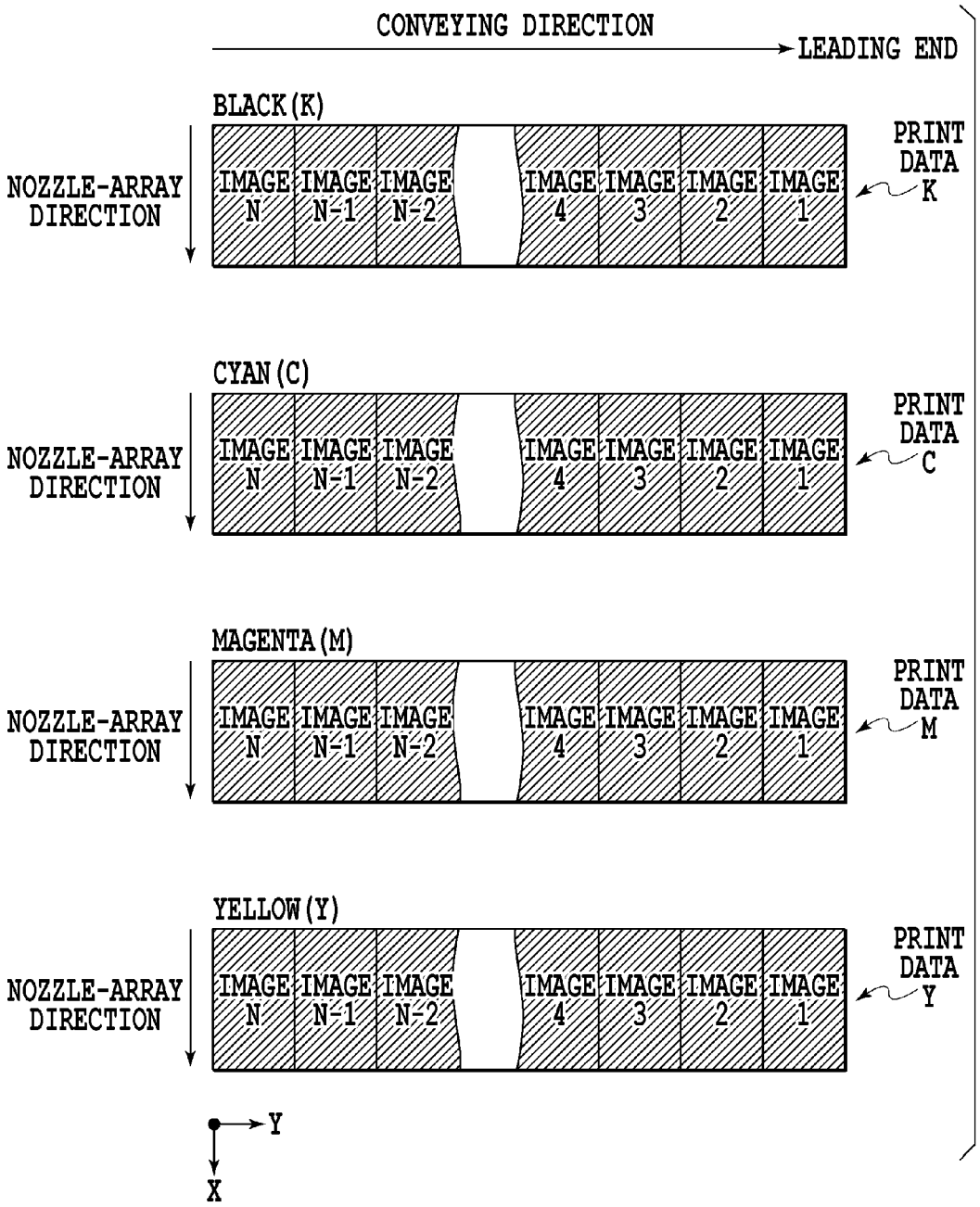
FIG. 5 is a schematic diagram illustrating an array of images to be printed by each of the print heads.

FIG. 5 is a schematic diagram illustrating an array of images to be printed by each of the print heads 4*a* to 4*d*, in which sets of print data K, C, M, Y are formed respectively of print data to be printed by the print heads 4*a* to 4*d*. The print data is obtained by performing predetermined image processing on the image data for quantization, in which printing (1) or non-printing (0) of a dot on each individual pixel is defined.

As illustrated in FIG. 5, in all the print heads, an image is printed in the order of image 1 to image N shown in FIG. 5, and the image is printed by the print heads 4*a*, 4*b*, 4*c* and 4*d* in this order as described in FIG. 3. That is, the printing of an image 1 is first performed by the print head 4*a*, and then, in order, by the print head 4*b*, the print head 4*c* and the print head 4*d*, and thus, the printing of the image 1 is completed.

The CPU 201 reads print data stored in the RAM 203 or HDD 204 after having undergone processing at the image processing unit 207, and then sends the read print data to the engine control unit 208. The engine control unit 208 controls the print heads 4*a* to 4*d* to print images according to the sets of print data corresponding to the print heads 4*a* to 4*d*.

<Case which Null Data are Added to Print Data in Advance>

Figure 6:
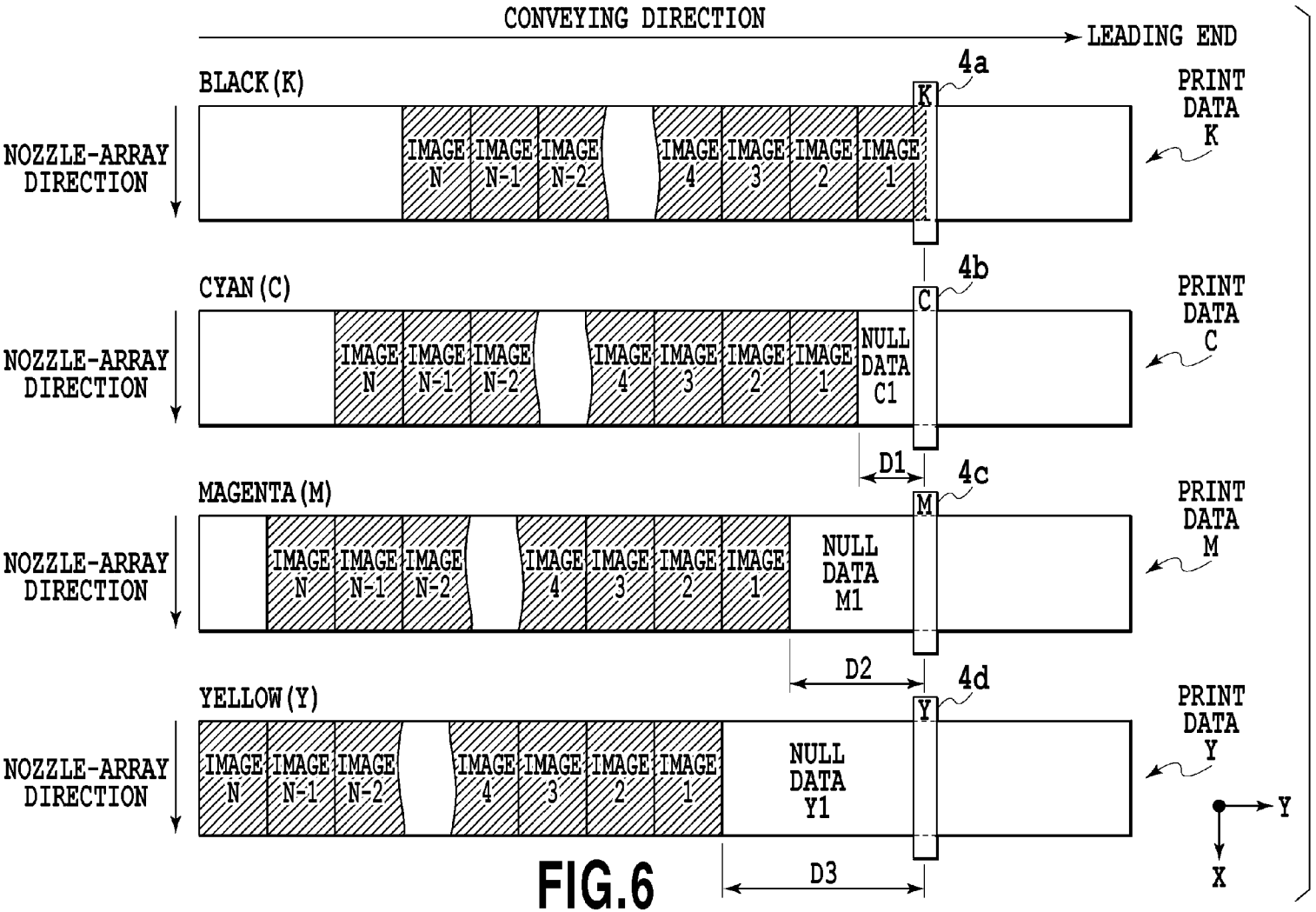
FIG. 6 is a schematic diagram illustrating print data for the individual print heads to which null data is preliminarily added.

FIG. 6 is a schematic diagram illustrating print data for the print heads 4*a* to 4*d*, for which null data have been added. As shown in FIG. 6, null data C1 to Y1, for each of which the number of lines corresponds to the distances D1 to D3, explained while referring to FIG. 3, are added to positions antecedent to the images 1 to be printed by the print heads 4*b* to 4*d*. Here, a line unit refers to a region on which printing is performed in one ejection operation by a nozzle array, which is a region of a 1-pixel width along the width direction of the print medium 3. The CPU 201 adds null data to the print data.

Figure 7:
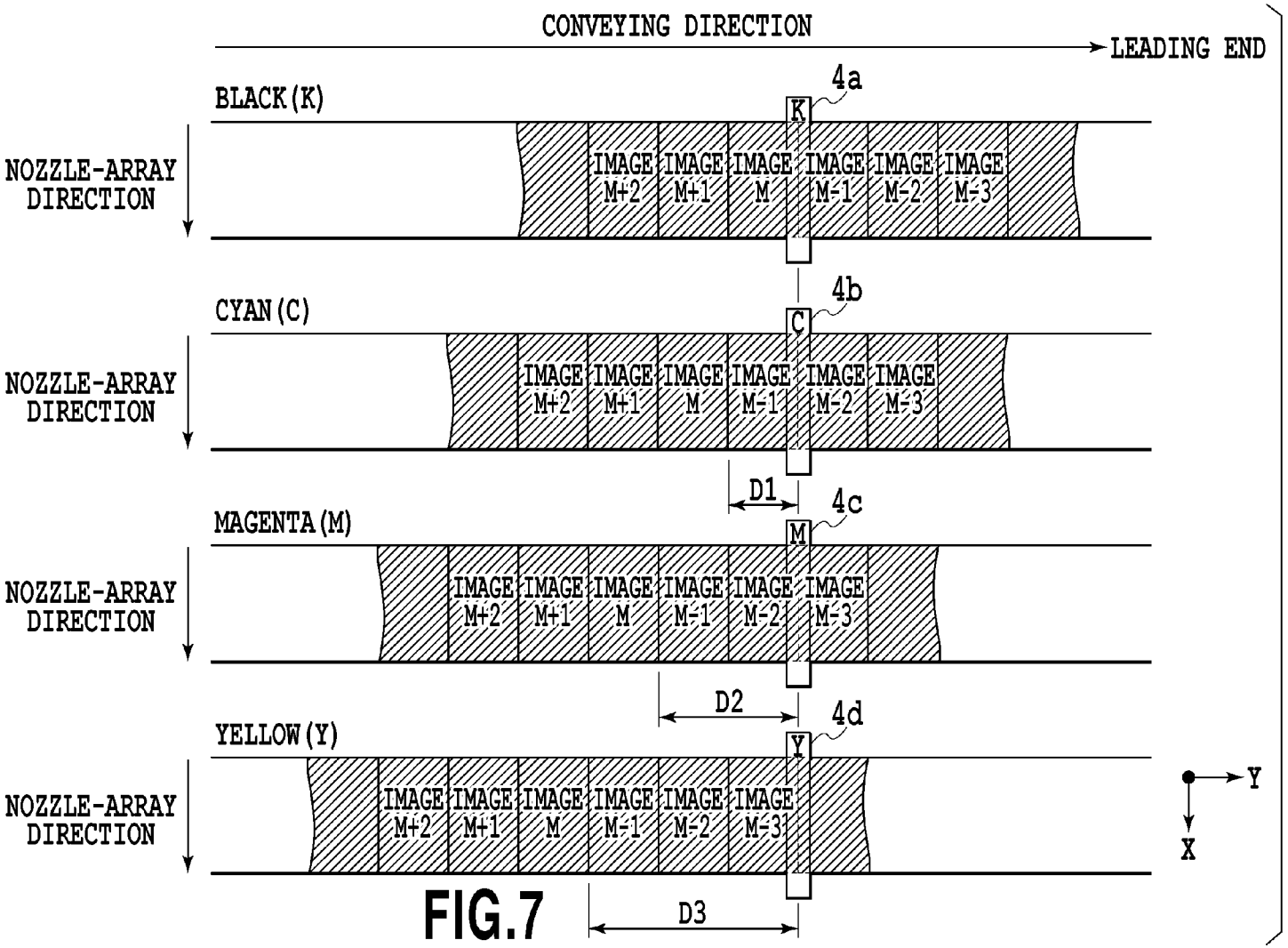
FIG. 7 is a schematic diagram illustrating print timing in the state shown in FIG. 6.

FIG. 7 is a schematic diagram illustrating print timing for the print data shown in FIG. 6. Specifically, FIG. 7 is a diagram schematically showing timing for printing image M, in which the amount of conveyance of the print medium 3 is a desired amount of conveyance.

As described in FIG. 6, the null data C1 having the number of lines corresponding to the distance D1 is added to the print data C for the print head 4*b* to precede the image 1. Accordingly, the printing position shift between the print heads 4*a* and 4*b* is able to be adjusted by the null data C1. As a result, as illustrated in FIG. 7, the printing of the image M can be started at a position at the distance D1 from the printing start position of an image M−1, which precedes the image M.

Likewise, as described in FIG. 6, the null data M1 having the number of lines corresponding to the distance D2 is added to the print data M for the print head 4*c* to precede the image 1. Accordingly, as illustrated in FIG. 7, the printing position shift between the print heads 4*a* and 4*c* can be adjusted by the null data M1.

Regarding the print head 4*d*, as described in FIG. 6, the null data Y1 having the number of lines corresponding to the distance D3 is added to the print data Y to precede the image 1. Accordingly, the printing position shift between the print heads 4*a* and 4*d* can be adjusted by the null data Y1 as shown in FIG. 7.

In this manner, when the amount of conveyance of the print medium 3 is equal to a desired amount of conveyance, the null data C1, M1, Y1 having respectively the numbers of lines corresponding to the distances D1, D2, D3 are added to the print data C, M, Y in advance, thus achieving the alignment of the print starting positions of the nozzle arrays of the respective print heads 4*a* to 4*d*.

As described above, when the amount of conveyance of the print medium 3 does not vary, by adding predetermined null data to print data beforehand, adjustment of timing for ejecting ink between nozzle arrays is achieved, so that the print positions on the print medium are aligned with each other between nozzle arrays. However, there is a case which the distance in which the printing medium 3 is conveyed might be changed. In such an event, the null data is added to the head of the print data in advance, but if the amount of conveyance of the print medium 3 is changed, print positions of the nozzle arrays are not aligned with each other on the print medium 3.

To avoid this, in the present embodiment, during printing of an image to the print medium 3, an inspection pattern is printed on a non-image region to be read by the inspection unit 6. The inspection unit 6 transmits the read information to the controller 17. The controller 17 determines the printing position shift between the nozzle arrays from the information (reading result) acquired from the inspection unit 6, and adds adjustment data (non-image data/null data) having the number of lines (the number of pixels) according to the shift to between images of each print head as an adjustment pattern.

In this manner, the number of lines of the adjustment data to be added is appropriately adjusted according to the amount of shift of the print positions. As a result, in the present embodiment, even if the amount of conveyance is changed during printing of an image on the print medium 3, a correction for the printing position shift can be made. The following is a concrete description of a correction method in the present embodiment.

<Case which a Conveying Distance is Shorter than a Desired Distance>

First, the case where the amount of conveyance of the print medium 3 is shorter than a desired amount of conveyance will be described. FIGS. 8A to 8D are schematic diagrams showing print timing when the amount of conveyance of the print medium 3 is short as compared with the case in FIG. 7.

When the amount of conveyance is equal to the desired amount of conveyance, at the timing when the print head 4*a* starts printing the head of an image M, the print head 4*b* starts printing an image M−1 (see FIG. 7). However, when the amount of conveyance of the print medium 3 is shorter than the desired amount of conveyance, at the timing when the print head 4*a* starts printing the head of an image M, the head of the image M−1 which has been printed by the print head 4*a* is located upstream of the position of the print head 4*b*.

Figure 8:
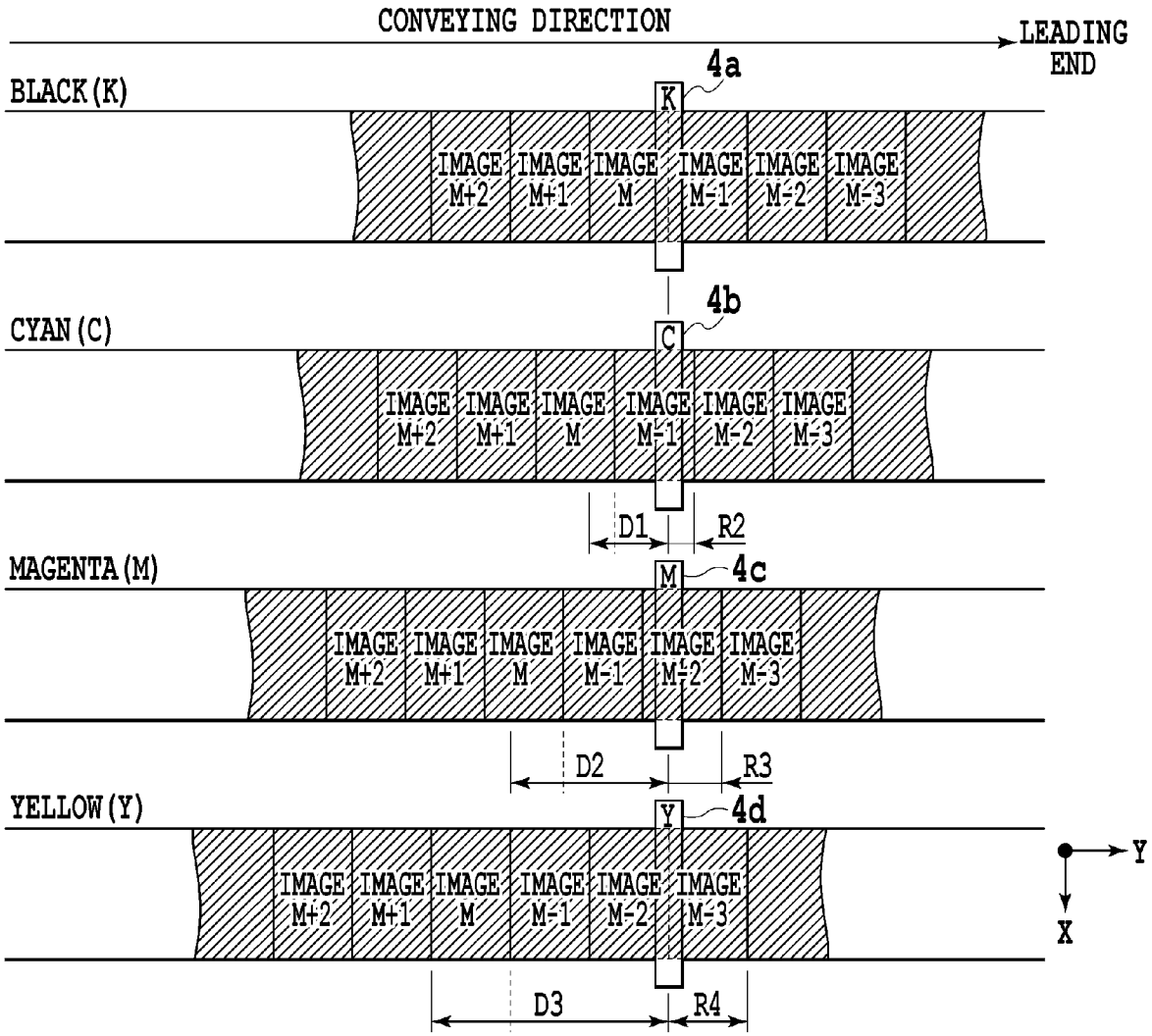
FIG. 8A is a schematic diagram showing printing when the amount of conveyance is short as compared with FIG. 7.
FIG. 8B is a schematic diagram showing printing when the amount of conveyance is short as compared with FIG. 7.
FIG. 8C is a schematic diagram showing printing when the amount of conveyance is short as compared with FIG. 7.
FIG. 8D is a schematic diagram showing printing when the amount of conveyance is short as compared with FIG. 7.

At the timing when the head of the image M−1 printed by the print head 4*a* is located actually in the print position of the print head 4*b*, as shown in FIG. 8B, the print head 4*b* has already printed R2 lines of the image M−1. Likewise, at the timing when the head of the image M−2 printed by the print head 4*a* is located actually in the print position of the print head 4*c*, as shown in FIG. 8C, the print head 4*c* has already printed R3 lines of an image M−2.

Further, at the timing when the head of an image M−3 printed by the print head 4*a* is located actually in the print position of the print head 4*d*, as shown in FIG. 8D, the print head 4*d* has already printed R4 lines of the image M−3.

As illustrated in FIGS. 8A to 8D, when the amount of conveyance of the print medium 3 is shorter than the desired amount of conveyance, in the print heads 4*b* to 4*d*, the image M is printed from a position preceding a desired print starting position. Therefore, in the printing of the image M by the print head 4*b*, the print head 4*b* prints the image M on a portion of the image M−1 which has been printed by the print head 4*a* before printing the image M. Such a printing position shift is similarly produced in the print head 4*c*. In the print head 4*d*, the image M is printed on the image M−1 which has been printed by the print head 4*a*.

In the present embodiment, even if such a printing position shift has occurred, the adjustment data (null data) is added as an adjustment pattern to the print data in order to adjust the print position for correction for the printing position shift.

Specifically, as described above, the inspection unit 6 reads the inspection pattern printed by the printing unit 5 in order to measure the amount of the printing position shift. For correction for the printing position shift, adjustment data are added respectively to the print data for the print heads. Then, when the amount of conveyance is shorter than a predetermined amount as described in the present embodiment, as a print head is located in the more downstream side, the number of lines for the adjustment data (null data) added before the image M is made the larger. As a result, the timing for printing the image M is retarded. Thus, print starting positions of all the print heads are adjusted.

Figure 9:
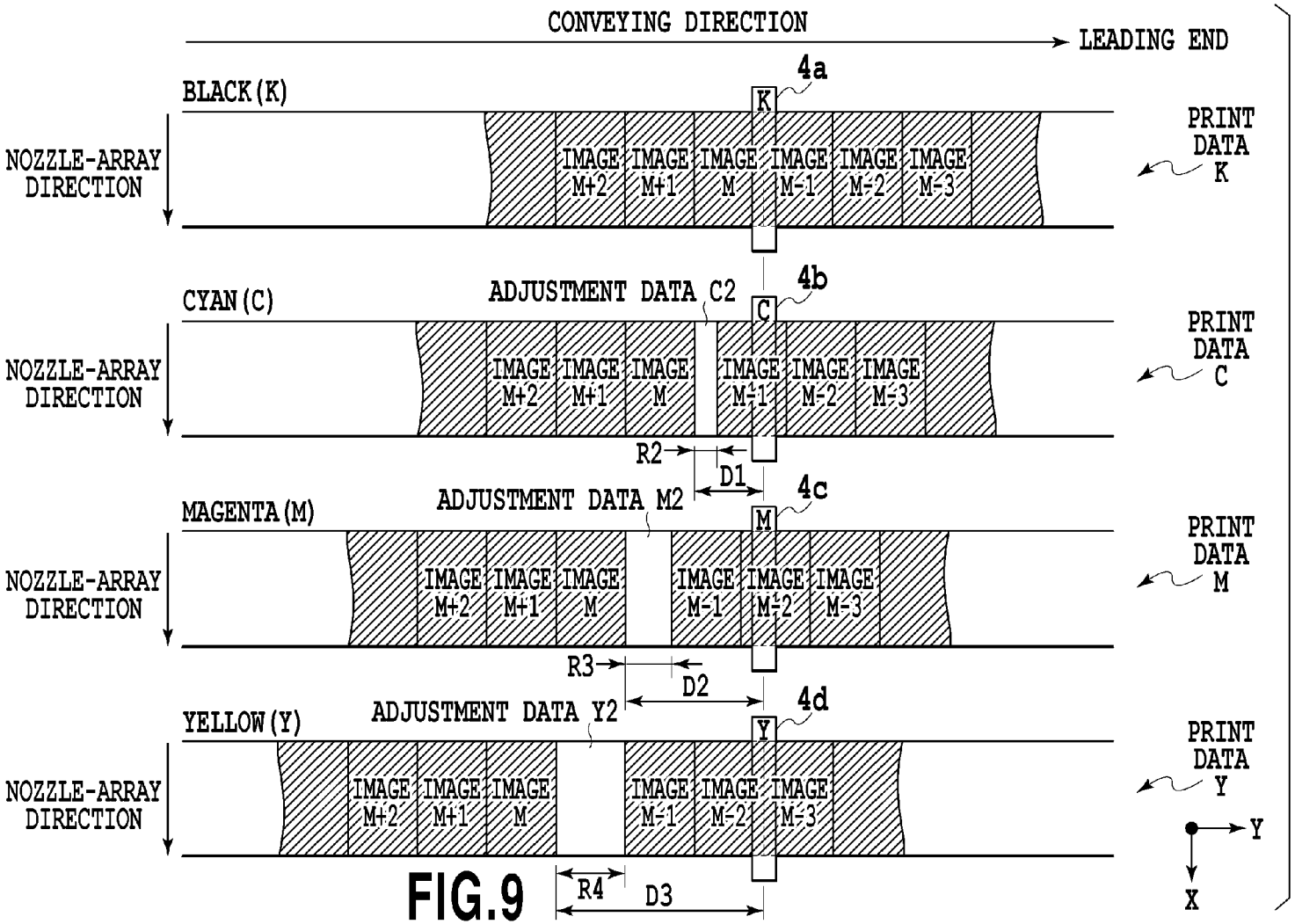
FIG. 9 is a schematic diagram illustrating the printing after correction for the states shown in FIGS. 8A to 8D.

This method will be described with reference to FIG. 9. FIG. 9 is a schematic diagram illustrating the state of bringing print positions of the image M into proper alignment with each other by use of the four print heads after the correction for the state shown in FIGS. 8A to 8D. If the CPU 201 calculates that the amount of conveyance of the print medium 3 is shorter than a desired amount of the conveyance, the adjustment data C2, M2, Y2 are added respectively to the print data C, M, Y for the print heads 4*b*, 4*c*, 4*d* in which the print position shift has occurred.

Between the image M−1 and the image M, adjustment data C2 corresponding to R2 lines is added for the print head 4*b*, adjustment data M2 corresponding to R3 lines is added for the print head 4*c*, and the adjustment data Y2 corresponding to R4 lines is added for the print head 4*d*. The number of lines R3 of the adjustment data M2 is set to be greater than the number of lines R2 of the adjustment data C2, while the number of lines R4 of the adjustment data Y2 is further greater than the number of lines R3 of the adjustment data M2.

In this manner, adding the adjustment data C2, M2, Y2 allows the print starting positions of the respective print heads for the image M to be aligned on the print medium, thus correcting the printing position shift.

<A Case which a Conveying Distance is Longer than a Desired Distance>

Next, the case where the amount of conveyance of the print medium 3 is longer than a desired amount of conveyance will be described. FIGS. 10A to 10D are schematic diagrams showing print timing when the amount of conveyance of the print medium 3 is longer as compared with the case in FIG. 7.

When the amount of conveyance is equal to a desired amount of conveyance, at the timing when the print head 4*a* starts printing the head of an image M+1, the print head 4*b* starts printing an image M (see FIG. 7). However, when the amount of conveyance of the print medium 3 is longer than the desired amount of conveyance, at the timing when the print head 4*a* starts printing the head of the image M+1, the head of the image M which had been printed by the print head 4*a* has been already located downstream of the position of the print head 4*b*.

Figures 10A, 10B, 10C, 10D:
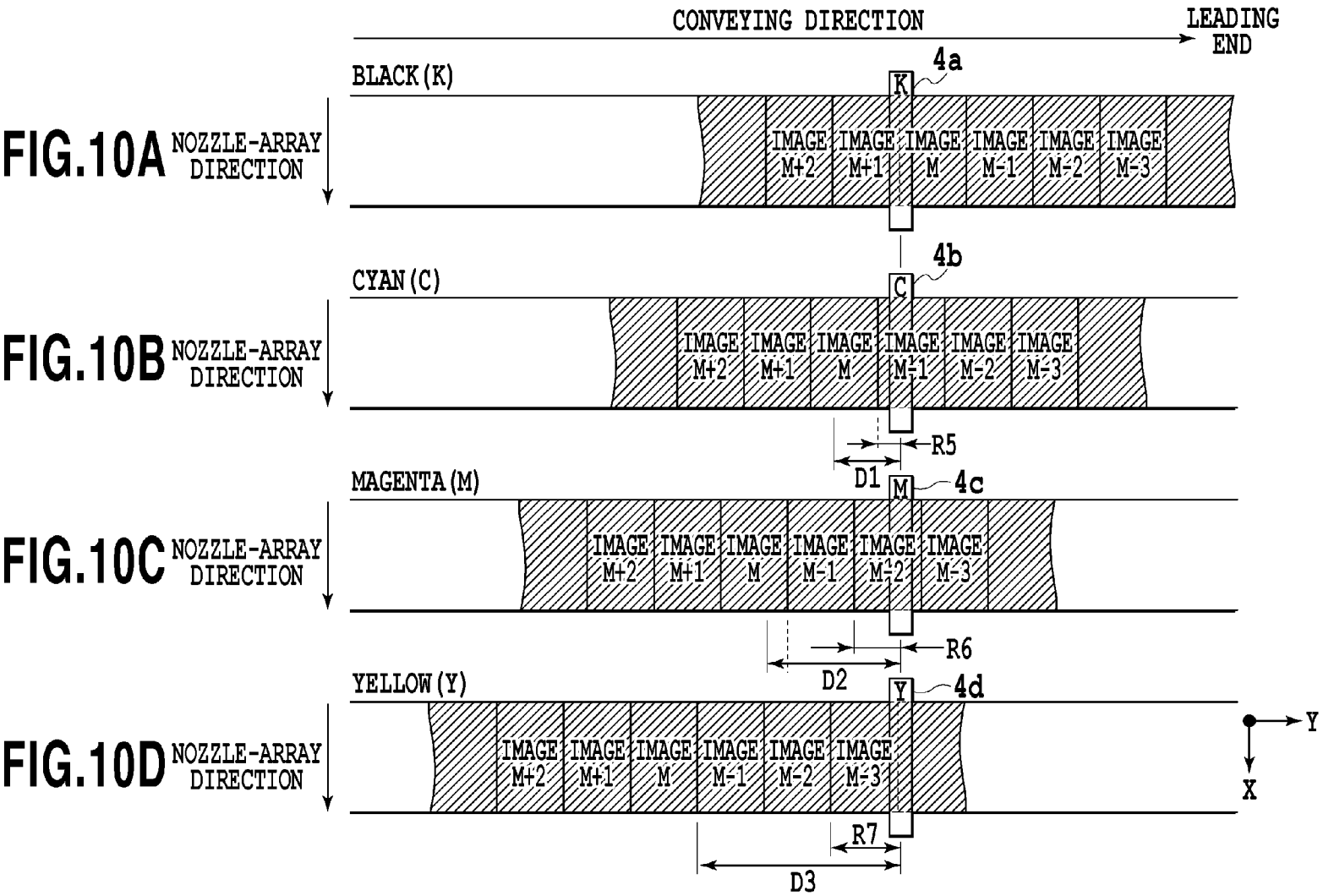
FIG. 10A is a schematic diagram showing printing when the amount of conveyance is long as compared with FIG. 7.
FIG. 10B is a schematic diagram showing printing when the amount of conveyance is long as compared with FIG. 7.
FIG. 10C is a schematic diagram showing printing when the amount of conveyance is long as compared with FIG. 7.
FIG. 10D is a schematic diagram showing printing when the amount of conveyance is long as compared with FIG. 7.

Then, at the timing when the head of the image M printed by the print head 4*a* is located actually in the print position of the print head 4*b*, as shown in FIG. 10B, the print head 4*b* is still printing the image M−1 and there are R5 lines not yet printed by the print head 4*b*.

Likewise, at the timing when the head of the image M−1 printed by the print head 4*a* is located actually in the print position of the print head 4*c*, as shown in FIG. 10C, the print head 4*c* is still printing the image M−2 and there are R6 lines not yet printed by the print head 4*c*. Further, at the timing when the head of the image M−2 printed by the print head 4*a* is located actually in the print position of the print head 4*d*, as shown in FIG. 10D, the print head 4*d* is still printing the image M−3 and there are R7 lines not yet printed by the print head 4*d*.

In the present embodiment, the printing position shift is corrected by adding adjustment data (null data) having the number of lines capable of correcting the position shift to the print data for each of the print head 4*a* to 4*c*.

Figure 11:
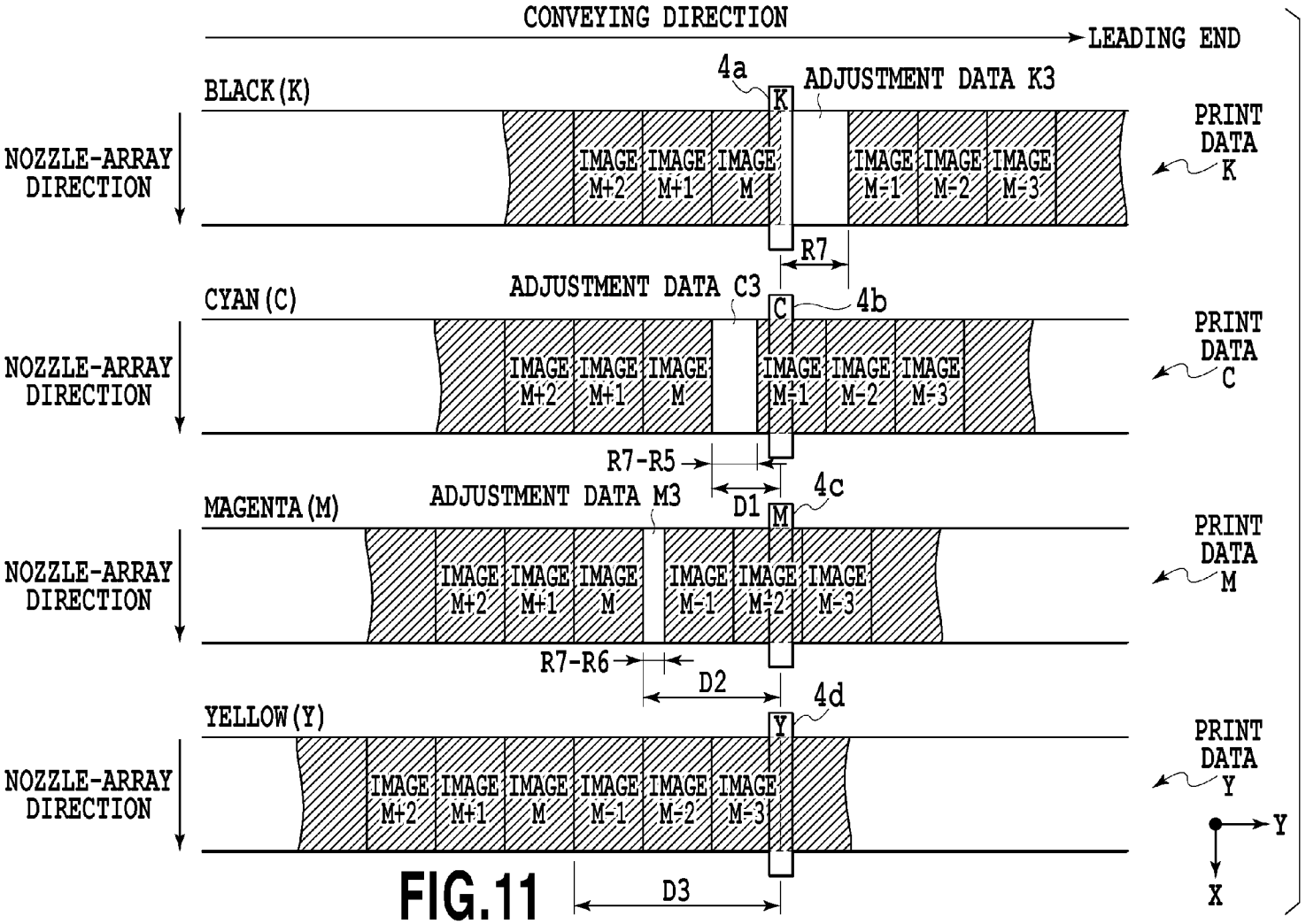
FIG. 11 is a schematic diagram illustrating the state after correction for the states shown in FIGS. 10A to 10D.

FIG. 11 is a schematic diagram illustrating the state of bringing print positions of the image M into proper alignment with each other by use of the four print heads after the correction for the state shown in FIGS. 10A to 10D. When the CPU 201 calculates that the amount of conveyance of the print medium 3 is longer than a desired amount of the conveyance, the adjustment data K3, C3, M3 are added respectively to the print data K, C, M for the print heads 4*a*, 4*b*, 4*c*.

As illustrated in FIG. 11, between the image M−1 and the image M, adjustment data K3 corresponding to R7 lines is added for the print head 4*a*, and adjustment data C3 corresponding to (R7−R5) lines is added for the print head 4*b*. Adjustment data M3 corresponding to (R7−R6) lines is added for the print head 4*c*.

The number of lines (R7−R5) of the adjustment data C3 is set to be greater than the number of lines (R7−R6) of the adjustment data M3, while the number of lines R7 of the adjustment data K3 is further greater than the number of lines (R7−R5) of the adjustment data C3.

In this manner, the adjustment data K3, C3, M3 are added respectively to the print data K, C, M. As a result, the print starting positions of the respective print heads 4*a*, 4*b*, 4*c*, 4*d* for the image M are aligned on the print medium, thus correcting the printing position shift.

In the present embodiment, when the amount of conveyance of the print medium 3 is shorter than a desired length, the number of lines of adjustment data added to print data for a print head located downstream in the conveying direction is increased to exceed the number of lines of adjustment data added to print data for a print head located upstream in the conveying direction. On the other hand, when the amount of conveyance of the print medium 3 is longer than a desired amount of conveyance, the number of lines of adjustment data added to print data for a print head located upstream in the conveying direction is increased to exceed the number of lines of adjustment data added to print data for a print head located downstream in the conveying direction.

In this manner, the number of lines for adding adjustment data (null data) as an adjustment pattern is increased/decreased as needed. This enables alignment of print starting positions of the respective print heads on the print medium, thus correcting the printing position shift between print heads (nozzle arrays).

In the present embodiment, the inspection unit located downstream of a plurality of the print heads in the conveying direction detects a pattern for inspecting the amount of the printing position shift between print positions printed by a plurality of the print heads located upstream in the conveying direction. By this detection, the amount of the printing position shift is acquired and adjustment data having the number of lines corresponding to the amount of the printing position shift is added to print data for each print head. Thus, even when the amount of conveyance of the print medium 3 is changed, the print starting position of each nozzle array is capable of being adjusted to correct the shift of a print position in relation to a reference print position.

<Variation in Amount of Conveyance>

In the printing apparatus 1 performing printing on the print medium 3 which is held in a web form, a variation in the amount of conveyance of the print medium 3 per unit time occurs in roughly two cases as follows.

Case I such a variation occurs while a sequence of images are being formed on the print medium 3.

Case II such a variation occurs when, after the print medium 3 on which a sequence of images are formed is cut by the cutting unit, the remaining print medium 3 is temporarily wound up and then the print medium 3 is conveyed in order to form a sequence of images on the print medium 3.

As described above, a variation in the amount of conveyance of the print medium 3 per unit time causes a printing position shift between nozzle arrays. The above description is given of the printing position shift associated with a variation in the amount of conveyance on the assumption of the case I. The following description will be given of the printing position shift associated with a variation in the amount of conveyance occurring in the case II. Specifically, a description is given of the printing position shift resulting from an error in the amount of conveyance when, assuming that a print medium with an image printed on is a set, a plurality of sets are output.

Figure 12:
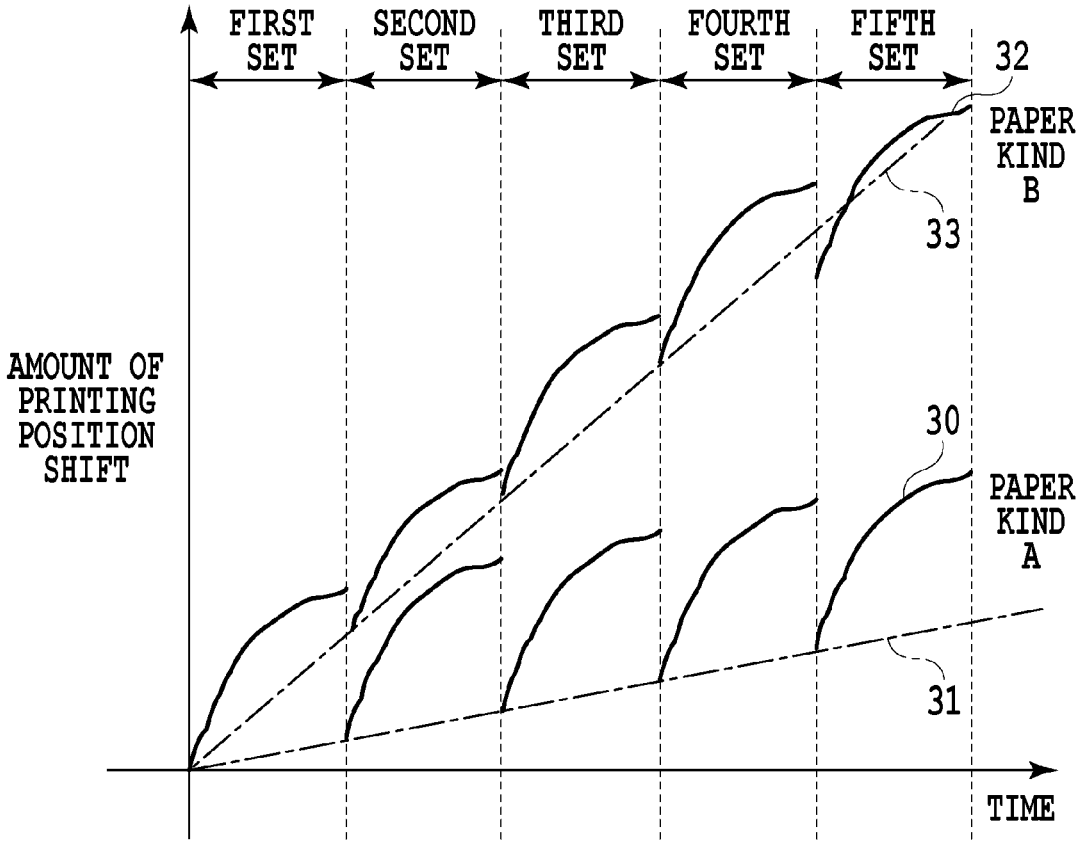
FIG. 12 is a graph illustrating variations in the amount of a printing position shift.

FIG. 12 is a graph illustrating a variation in the amount of a printing position shift. The graph in FIG. 12 shows a variation in the amount of a printing position shift between two print heads. The case shown in FIG. 12, a print medium 3 that was cut into 10-m length after an image has been printed is one set, five sets are output. For the one set, the processes of supplying the print medium 3, printing the print medium 3, cutting the print medium 3, discharging the print medium 3 and winding up the remaining print medium 3 are performed.

FIG. 12 also shows the examples of using a print medium A and a print medium B as the print medium 3, which are identical in length (width) in the main scanning direction and differ in kind. It should be noted that FIG. 12 shows a variation in the amount of the printing position shift between the print head 4*a* and the print head 4*d*.

In FIG. 12, FIG. 13, FIG. 16 and FIG. 17 described later, the Y axis represents the amount of a printing position shift, while the X axis represents time. A solid line 30 in FIG. 12 shows a variation in the amount of a printing position shift when the print medium A is used, while a solid line 32 shows a variation in the amount of a printing position shift when the print medium B is used. A dot-dash line 31 shows an approximate straight line connecting the amounts of a printing position shift accumulated at leading end portions (leading-end regions) of the respective sets when the print medium A is used. Likewise, a dot-dash line 33 shows an approximate straight line connecting the amounts of the printing position shift accumulated at leading end portions of the respective sets when the print medium B is used.

As shown in FIG. 12, in either of the two cases of using the print medium. A and the print medium B, the amount of the printing position shift in the leading end portion is increased every time the number of sets increases. As shown in FIG. 12, the amount of the printing position shift in the preceding set is accumulated to the amount of the printing position shift occurred at each of leading end portions of the second and subsequent sets.

In FIG. 12, a change in the positive direction of the amount of the printing position shift shows that a print position of the print head 4*d* in relation to the print position of the print head 4*a* is located on the upstream side in the conveying direction of the print medium. Specifically, between the print head 4*a* and the print head 4*d*, the conveying speed of the print medium is increased, so that the amount of conveyance of the print medium becomes longer than a desired amount of conveyance, resulting in an increase in the amount of the printing position shift.

As shown in FIG. 12, the gradient of the dot-dash line 31 is smaller than the gradient of the dot-dash line 33. In this manner, a variation in the amount of the printing position shift is different for each kind of print medium. This is because the amount of conveyance of a print medium per unit time is different for each kind of print medium.

A cause of a variation in the amount of conveyance of a print medium varying from kind of print medium to another is the fact that, since each of print mediums differ the amount of paper powder depending to material quality and the manufacturing process and the like, even if the print mediums are identical in the amount of conveyance, a difference in the amount of paper powder adhering to a convey roller causes variations in substantive roller diameter of the convey roller. As another cause, because of variations in hygroscopic degree from kind of print medium to another, the amount of conveyance is variously affected by a change in humidity conditions of the printing apparatus, a change in humidity conditions occurred from ejection of ink to fixation of ink to the print medium, and the like. As a result, during printing on one set, a difference in the amount of conveyance per unit time may be caused between the leading end portion of the print medium and other portions of the print medium.

Further, when print mediums are of the same kind, but differ in size, even if the same print contents are repeatedly printed on sets, the amount of conveyance of the print medium per unit time may vary, so that the tendency of the amount of the printing position shift may differ between leading end portions. In the double-sided printing, if different finishing processes are applied to the two sides of a print medium, the amount of conveyance of the print medium may be different on each side. As a result, the tendency of the amount of the printing position shift may vary from side to side.

In this manner, if a change in the coefficient of friction between the print medium and the conveying roller results from a variety of causes such as a kind of the print medium, a size of the print medium and the like, the amount of conveyance of the print medium per unit time changes. The accumulation state of the amounts of the printing position shift may differ from cause to cause.

<Printing Position Shift at Leading End Portion of the Print Medium 3>

If an image is printed on the print medium 3 and then the print medium 3 is cut into 10 m, a printing position shift in a portion other than the leading end portion of the 10 meters can be corrected by adding adjustment data with an adjusted number of lines to the print data according to the result of reading the inspection pattern as described earlier.

However, as illustrated in FIGS. 1 and 2, a fixed distance D5 exists between the printing unit 5 and the inspection unit 6. Therefore, even when the inspection pattern is printed on the head of the print medium 3, unless a non-print region corresponding to the distance D5 between the printing unit 5 and the inspection unit 6 is provided, a printing position shift in the head of the print medium 3 cannot be corrected by adding the adjustment data to the print data, or the like.

On this account, for every increase in the number of sets, the amount of the printing position shift in a leading end portion may be accumulated, thus there is a case that the cumulative amount of printing position shift in the leading end portions exceeds a permissible limit to cause the printing position shift to reduce the image quality.

Figure 13:
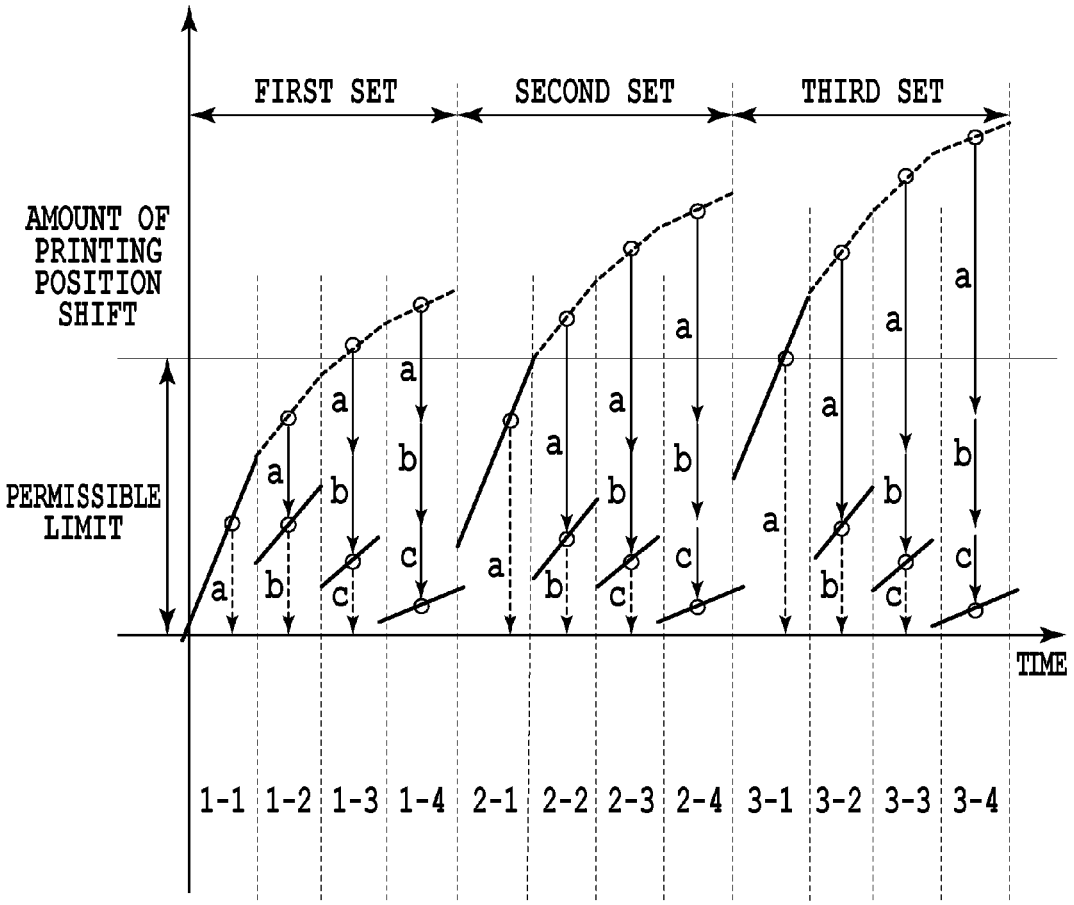
FIG. 13 is a graph illustrating a permissible limit in the amount of the printing position shift.

FIG. 13 is a graph for description of the permissible limit of the amount of a printing position shift, showing details of the amount of the printing position shift after printing has been performed on three sets using the print medium A shown in FIG. 12.

As shown in FIG. 13, in the first set, if a printing position shift is occurred as the amount a of the printing position shift in a leading end portion (section 1-1) of the print medium, the amount a of the printing position shift is accumulated to the amount of a printing position shift occurred in portions subsequent to the leading end portion.

Specifically, the amount of a printing position shift occurred in a forward central portion (section 1-2) subsequent to the leading end portion is a total of the amount a of the printing position shift and the amount b of a printing position shift newly occurred at this time. The printing position shift in the forward central portion is also accumulated to the amount of a printing position shift occurred in portions subsequent to the forward central portion. Accordingly, the amount of a printing position shift occurred in a rearward central portion (section 1-3) subsequent to the forward central portion is a total of the amounts a and b of the printing position shift and the amount c of the printing position shift newly occurred at this time.

Likewise, the amount of a printing position shift produced in a rear end portion (rear-end region, section 1-4) subsequent to the rearward central portion is a total of the amounts a, b and c of the printing position shift and the amount of a printing position shift newly occurred at this time. Such a printing position shift is occurred similarly on the second and subsequent sets.

As described earlier, in the region other than the leading end portion, the amount of the printing position shift in the preceding region is determined from the inspection pattern. Then, according to this determination, the printing position shift in the region subsequent to the preceding region can be corrected.

For example, in the printing of the forward central portion (section 1-2) shown in FIG. 13, the amount a of the printing position shift in the leading end portion (section 1-1) is determined from the inspection pattern. Then, according to this determination, the printing position shift can be corrected. However, as described above, in the leading end portion, even if the inspection pattern is printed on the head to obtain the amount of the printing position shift, unless a non-print region corresponding to the distance between the printing unit 5 and the inspection unit 6 is provided, the printing position shift cannot be corrected by a method similar to that for other regions.

Therefore, as shown in FIG. 13, in the use of the print medium A, the amount of the printing position shift in the leading end portion is increased every time the number of sets increases such as a first set and then a second set followed by a third set. Then, in the third set, the amount of the printing position shift in the leading end portion exceeds the permissible limit.

Figure 14:
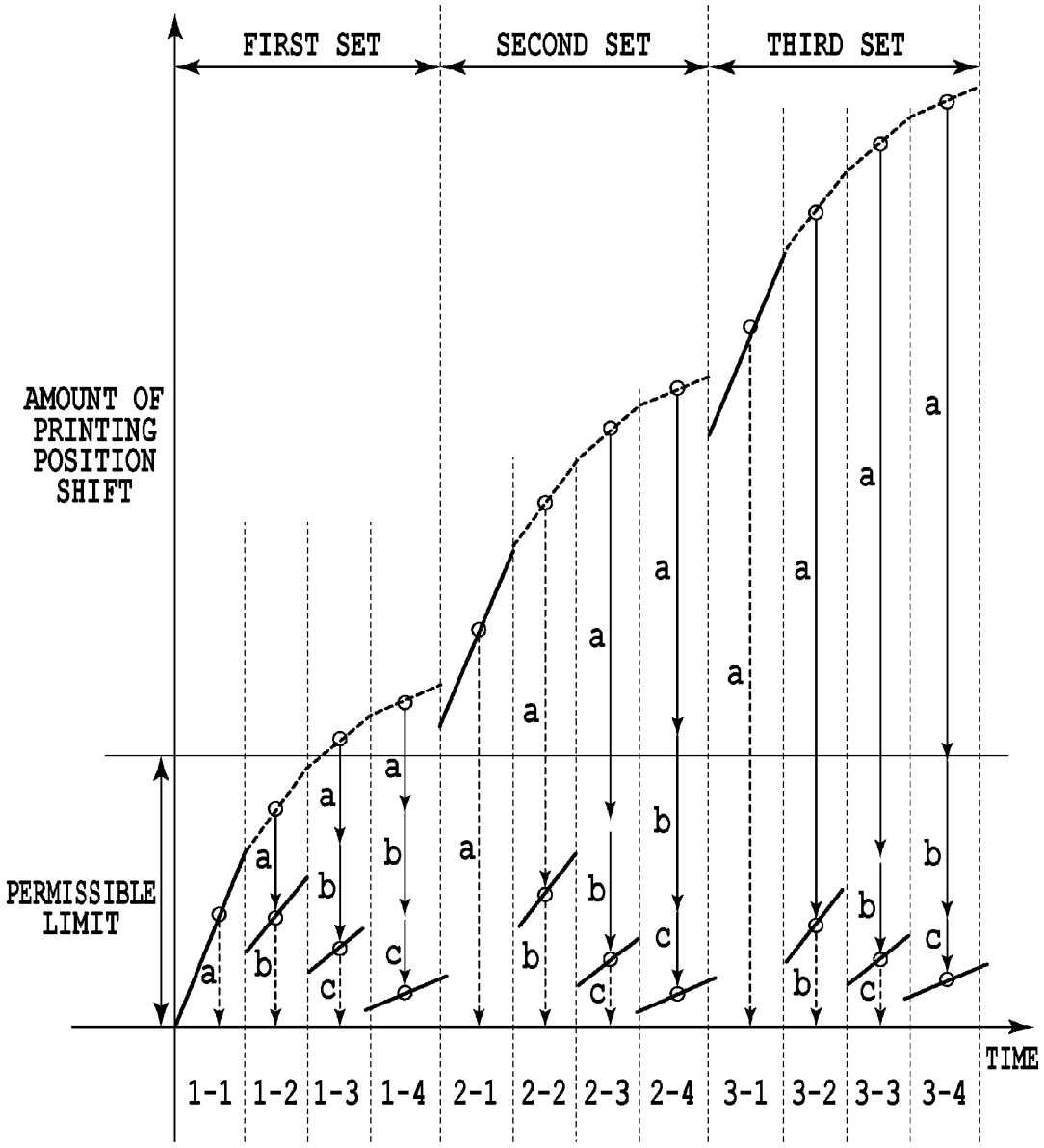
FIG. 14 is a graph illustrating a permissible limit in the amount of the printing position shift.

FIG. 14 is a graph for description of the permissible limit of the amount of a printing position shift, showing details of the amount of the printing position shift after printing has been performed on the third set of the print medium B shown in FIG. 12.

In the use of the print medium B as shown in FIG. 14, as in the case of using the print medium A described with reference to FIG. 13, the amount of a printing position shift in a preceding region is accumulated to the amount of a printing position shift in the region subsequent to the preceding region.

In the case, in regions other than the leading end portion, the amount of a printing position shift is determined from the inspection pattern detected in the preceding region, so that the printing position shift is corrected according to the determination. However, as described above, in the leading end portion, the printing position shift cannot be corrected by a method similar to that for other regions.

Therefore, as shown in FIG. 14, in the use of the print medium B, the amounts of printing position shifts in the leading end portion (section 2-1) of the second set and the leading end portion (section 3-1) of the third set exceed the permissible limit.

As shown in FIG. 13 and FIG. 14, if the amount of the printing position shift exceeds the permissible limit, a reduction in image quality may be caused. To avoid this, in the present embodiment, the amount of the printing position shift in all regions of each set falls within the permissible limit to prevent the reduction in image quality. Hereinafter, a description will be made of the flow for calculating correction values for correction for a printing position shift with reference to FIGS. 15A, 15B.

<Processing Flow in the Embodiment>

Figure 15A:
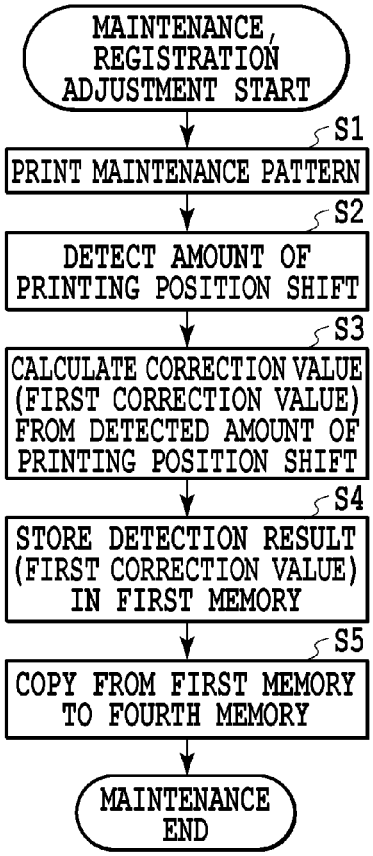
FIG. 15A is a flowchart of the flow of the processing.
Figure 15B:
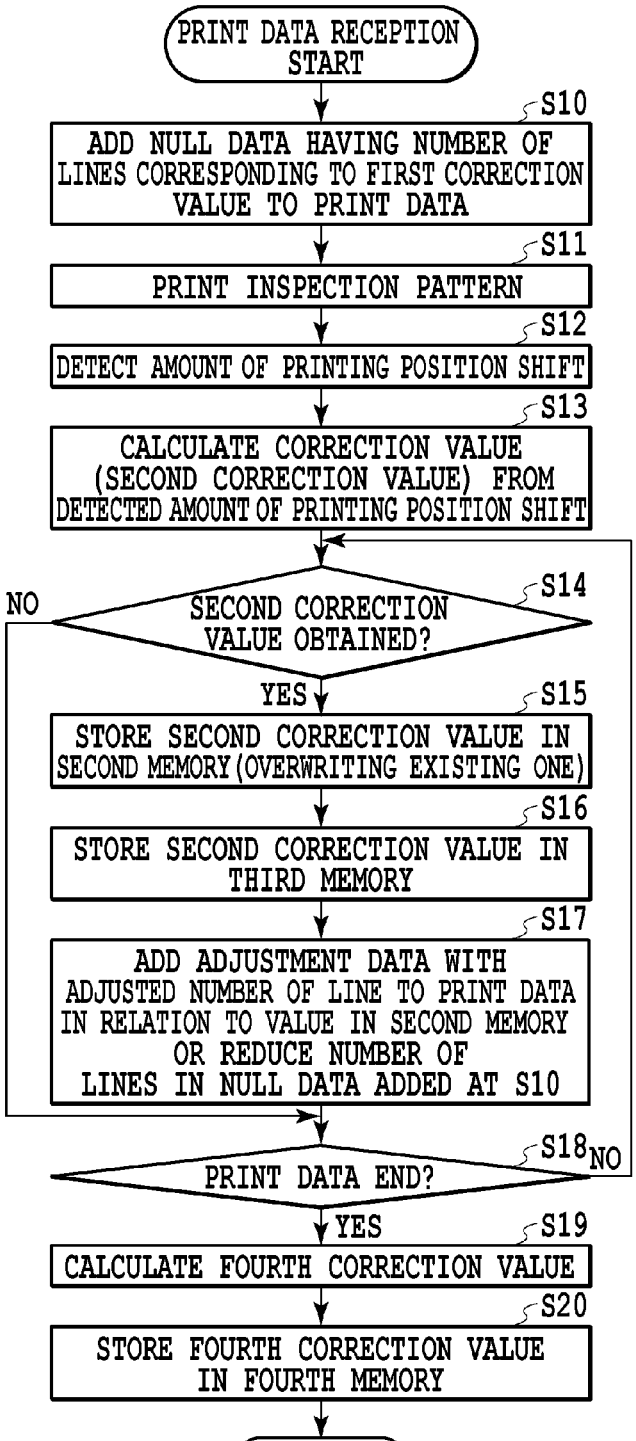
FIG. 15B is a flowchart of the flow of the processing.

FIGS. 15A and 15B are flowcharts showing the processing flows according to the present embodiment. FIG. 15A shows the flow of maintenance processing, while FIG. 15B shows the processing flow for calculating correction values for use in correction for the printing position shift occurred in the leading end portion of the print medium. The maintenance processing shown in FIG. 15A is performed at predetermined timing or at the time of reception of maintenance instructions from the user. The processing shown in FIG. 15B is performed at the time of printing on each set.

As shown in FIG. 15A, upon start of registration adjustment as maintenance of the printing apparatus 1, a maintenance pattern is printed on the print medium 3 (S1). More specifically, CPU 201 controls the print unit 5 to print the maintenance pattern on the print medium 3 by ejection ink from nozzle of the print head. The inspection unit 6 reads the maintenance pattern to detect the amount of a printing position shift (S2). In this step, the amount of a printing position shift from the print head 4*a* (the amount of printing position shift occurred by the first cause) is determined as the basis of a printing position of the print head 4*a*. CPU 201 calculates a first correction value from the amount of the printing position shift (S3). Then, the first correction value is stored in the first memory 211 (S4). Further, the first correction value is stored in the fourth memory 214 (S5), terminating the maintenance.

Next, the processing flow for calculating a correction value for use in correction for a printing position shift in a leading end portion of a set subsequent to the preceding set will be described with reference to FIG. 15B. As shown in FIG. 15B, upon reception of print data, the processing is started. Relative to the first correction value stored in the fourth memory 214 in step S5 in FIG. 15A, print positions between print heads are adjusted (S10). Specifically, ejection timing of a print head to be adjusted is adjusted in relation to the reference print head. In the present embodiment, CPU 201 adds null data having the number of lines corresponding to the first correction value to the print data for the print head to be adjusted.

Next, an inspection pattern is printed on the non-image region between images as deliverables in a preset interval in relation to the length of the print data (S11). More specifically, CPU 201 controls the print unit 5 to print the inspection pattern on the print medium 3 by ejection ink from nozzle of the print head. The inspection unit 6 reads the inspection pattern to determine the amount of a printing position shift (the amount of a printing position shift occurred by the second cause) between print heads (S12). A second correction value is calculated from the amount of the printing position shift (S13).

Then, CPU 201 determines whether or not the second correction value is obtained (S14). When the interval is less than the preset interval, the inspection pattern is not printed, so that the second correction value is not obtained. Because of this, if the second correction value is not obtained, CPU 201 determines whether or not the print data is finished (S18). If the second correction value is obtained, the second correction value is stored in the second memory 212 (S15). The second correction value is also stored in the third memory 213 (S16). A plurality of second correction values are sequentially stored in the third memory 213 in accordance with the length of the print data.

From among the plurality of second correction values, the second correction value used to calculate a fourth correction value described later is selected by CPU 201. In the present embodiment, any second correction value stored in a preceding set is used for calculation of the fourth correction value.

In the present embodiment two ways of calculating a fourth correction value are practiced, one using a second correction value initially calculated in a preceding set and the other using a second correction value which has been used in the rear end region of a preceding set, which will be described later with reference to FIG. 16 and FIG. 17. However, anyone of the second correction values calculated in the preceding set to use for calculation of the fourth correction value can be appropriately selected depending on the kind of the print medium. For example, the fourth correction value may be calculated by use of a second correction value finally i.e. most recently calculated in the preceding set. Depending on the kind of the print medium, the fourth correction value may be calculated from a mean value of the plurality of the second correction values. More details will be described later with reference to FIG. 16 and FIG. 17.

In accordance with the second correction value stored in the second memory, CPU 201 adds adjustment data on an adjusted number of lines to the print data for the print head under correction, and the number of lines in the null data which has been added in step S10 is reduced. Then, it is determined whether or not the print data is finished (S18).

When the print data is not finished, the processes from step S14 to step S17 are repeated until the print data is finished. When the print data is finished, a fourth correction value is calculated (S19). In step S17, a computation is performed on the first correction value stored in the fourth memory 214 in step S5 in FIG. 15A and the second correction value stored in the third memory 213 in step S16 in FIG. 15B to calculate a fourth correction value.

As described earlier with reference to FIG. 12 to FIG. 14, a different kind of the print medium causes a different tendency of variation in the amount of a printing position shift. To address this, from one kind of the print medium to another, a method of calculating a fourth correction value used for correction of the printing position shift in a leading end portion may be varied. The calculating method will be described later with reference to FIG. 16 and FIG. 17.

The fourth correction value calculated in step S19 is stored in the fourth memory 214 (S20), terminating the processing. In the embodiment, when printing is performed on sets subsequent to the first set, the fourth correction value calculated in the preceding set is used to correct the print position shift in the leading end portion of a set subsequent to the preceding set.

<Correction for Printing Position Shift>

A description will be given of a variation in the amount of a printing position shift which has been occurred in a leading end portion to exceed a permissible limit (see FIG. 13 and FIG. 14) when the print position in the printing position shift is corrected by use of the fourth correction value calculated in the processing according to the present embodiment illustrated in FIGS. 15A, 15B.

Figure 16:
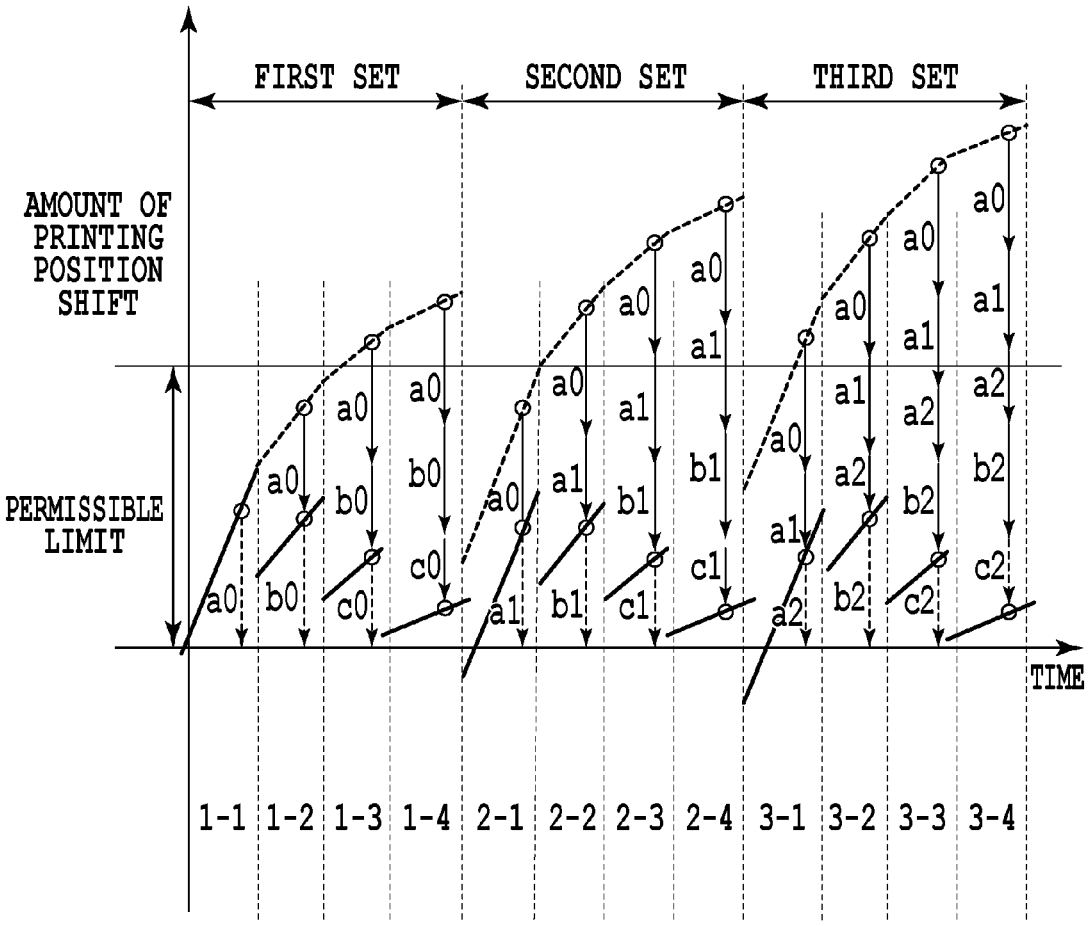
FIG. 16 is a graph showing the relationship between the amount of a printing position shift and time.

FIG. 16 is a graph showing the relationship between the amount of a printing position shift and time when the processing in FIGS. 15A and 15B is performed on the print medium A shown in FIG. 13. In FIG. 16 and FIG. 17, an empty circle (○) indicates detection timing for the inspection pattern, and a dotted line extending in the vertical direction to separate sections from each other indicates correction timing. The inspection pattern is printed at timing before the detection timing in each section, which is not shown. Therefore, in each region (each section), the amount of the printing position shift in the corresponding region is calculated from the read result of the inspection pattern.

Comparing between the graph shown in FIG. 16 and the graph shown in FIG. 13, it is seen that the amount of the printing position shift in the leading end portions of the second set and the third set is reduced. Specifically, in the graph shown in FIG. 16, it is seen that the amount of the printing position shift in each region of each set falls within the permissible limit.

Before starting printing on the first set, the method described in FIG. 15A is used to calculate a first correction value from the amount of the printing position shift occurred by the first cause. Then, as described step S10 in FIG. 15B, null data is added to the print data in accordance with the first correction value to correct the print position.

Then printing of an image is started. An inspection pattern is printed in the predetermined interval on the non-print region between images, which is then detected by the inspection unit 6. From the detection result, the amount of the printing position shift (a0 shown in FIG. 16) resulting from a variation in the amount of conveyance per unit time to occur in a leading end portion (section 1-1) of the first set shown in FIG. 16 is calculated. Then, a second correction value is calculated to correct the printing position shift.

For printing on a forward central portion (section 1-2), the number of lines, which is included in the null data added to the print data for the print head to be corrected in step S10 in FIG. 15B in the case shown in FIG. 16, is reduced in accordance with the second correction value to correct the printing position shift.

In the forward central portion (section 1-2), a second correction value is calculated from the amount (a0+b0) that is the sum of the amount of the printing position shift (a0) and the amount of a printing position shift (b0) newly occurring in the forward central portion. This second correction value is used to correct a printing position shift for printing on the subsequent rearward central portion (section 1-3). In the rearward central portion (section 1-3), a second correction value is calculated from the amount (a0+b0+c0) that is the sum of the amount of the printing position shift (a0+b0) and the amount of a printing position shift (c0) newly occurring in the rearward central portion (section 1-3). This second correction value is used to correct a printing position shift for printing on the subsequent rear end portion (section 1-4).

Upon completion of the printing on the first set, the print medium 3 is cut, and the remaining print medium 3 is temporarily wound up and then the print medium 3 is transitioned to a standby state to wait for reception of print data.

Upon reception of the print data for a second set, the print medium 3 is conveyed to the printing unit 5 again to start printing on the second set.

A print position in a leading end portion (section 2-1) of the second set shown in FIG. 16 is corrected by use of a value that is the sum of the first correction value and the second correction value calculated from the amount of the printing position shift (a0) occurring in the leading end portion of the first set. In regions subsequent to it, in a similar manner with the first set, the amount of the printing position shift is calculated from the inspection pattern printed on the second set, which is then used to calculate a second correction value. Then, the printing position shift is corrected in accordance with the second correction value. Upon completion of the printing on the second set, in a similar manner with the first set, the print medium 3 is cut, and the remaining print medium 3 is temporarily wound up and then the print medium 3 is transitioned to a standby state to wait for reception of print data.

A print position in a leading end portion (section 3-1) of a third set is corrected by use of a value that is the sum of the first correction value, the second correction value calculated from the amount of the printing position shift (a0) occurring in the leading end portion of the first set, and the second correction value calculated from the amount of a printing position shift (a1) in the leading end portion of the second set. In regions subsequent to it, in a similar manner with the first set, the printing position shift is corrected in accordance with the amount of the printing position shift calculated from the inspection pattern.

In this manner, a fourth correction value for correction for the printing position shift in the leading end portion when the print medium A is used is defined as follows.

A fourth correction value is equal to the sum of a first correction value calculated from the amount of the printing position shift occurred by a first cause and a second correction value calculated from the amount of the printing position shift in a leading end portion of the preceding set.

By using a fourth correction value thus calculated, as shown in FIG. 16, the amount of the printing position shift in each of the region including the leading end portion in each set can fall within the permissible limit. This enables preventing occurrence of printing position shift when the amount of conveyance of the print medium per unit time is changed, preventing the image quality from deteriorating by the amount of the printing position shift exceeding the permissible limit.

Next, the case of using the print medium B with a relatively larger variation in the amount of conveyance per unit time than the print medium A shown in FIG. 12 will be described with reference to FIG. 17.

Figure 17:
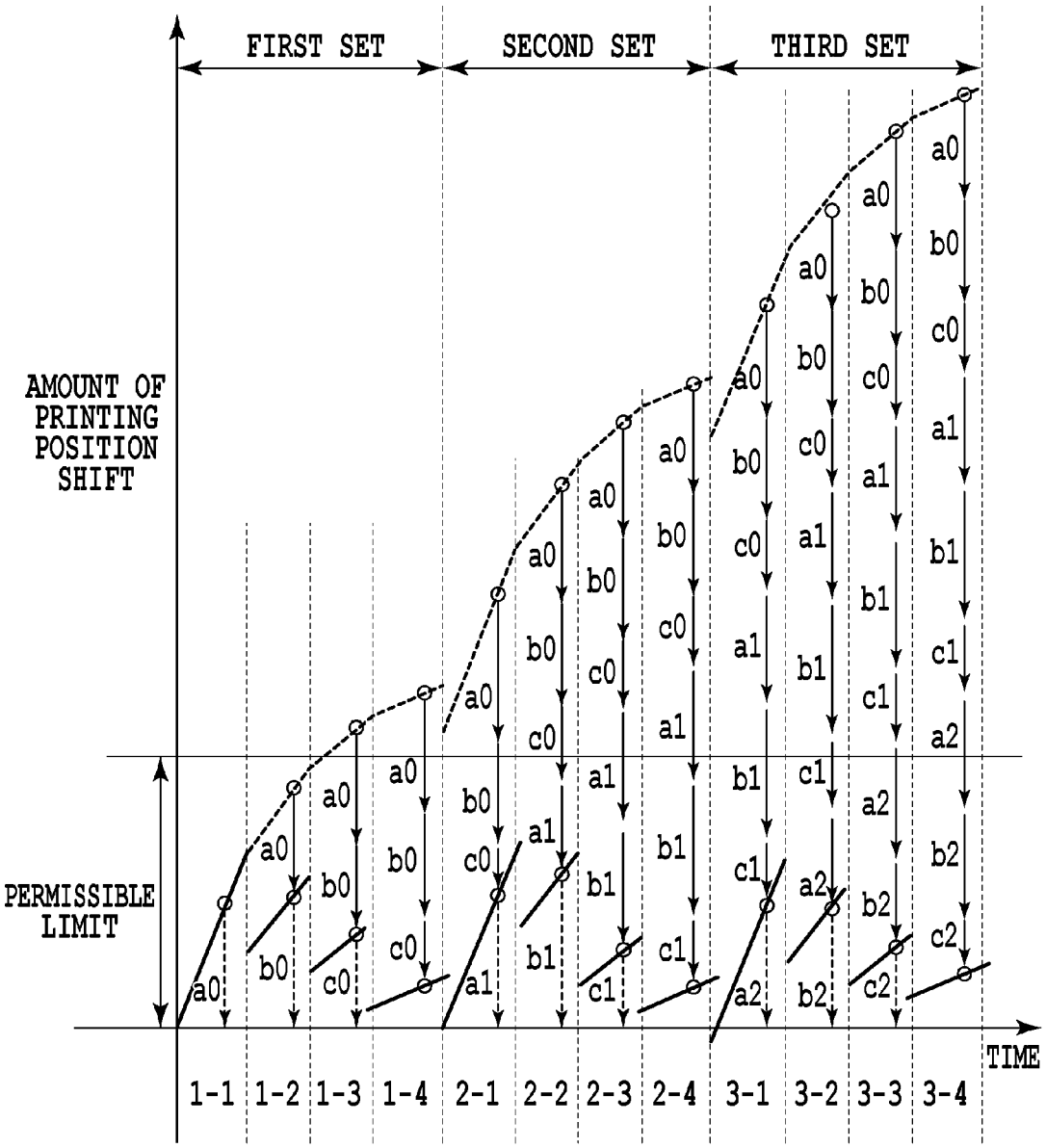
FIG. 17 is a graph showing the relationship between the amount of the printing position shift and time.

FIG. 17 is a graph showing the relationship between time and the amount of a printing position shift at the time of using the print medium B shown in FIG. 14 and performing the processing shown in FIGS. 15A and 15B. Comparing between the graph shown in FIG. 17 and the graph shown in FIG. 14, the amount of the printing position shift in the leading end portion exceeding the permissive limit in the graph in FIG. 14 falls within the permissive limit in the graph in FIG. 17.

Since the processing for the first set shown in FIG. 17 is the same as the processing for the first set described in FIG. 16, the description is omitted.

Upon reception of print data for the second set, the print medium 3 is conveyed to the printing unit 5 again to start printing on the second set.

A print position in a leading end portion (section 2-1) of the second set shown in FIG. 17 is corrected by use of a value that is equal to the sum of the first correction value and the second correction value used in correction for the rear end portion (section 1-4) of the first set. That is, in the leading end portion (section 2-1) of the second set, a print position is corrected by use of a value that is the sum of the first correction value and the second correction value calculated in the rearward central portion (section 1-3) of the first set.

In regions subsequent to it, the amount of the printing position shift is calculated from the inspection pattern printed on the second set, which is then used to calculate a second correction value. Then, the printing position shift is corrected in accordance with the second correction value. Upon completion of the printing on the second set, in a similar manner with the first set, the print medium 3 is cut, and the remaining print medium 3 is temporarily wound up and then the print medium 3 is transitioned to a standby state to wait for reception of print data.

Correction for a leading end portion (section 3-1) of a third set is performed by use of a value that is the sum of the first correction value, the second correction value used in the rear end portion of the first set, and the second correction value used in the rear end portion of the second set. In regions subsequent to it, in a similar manner with the second set, the printing position shift is corrected.

In this manner, a fourth correction value for correction for the printing position shift in the leading end portion at the time of using the print medium B with a relatively large variation in the amount of conveyance per unit time is defined as follows.

A fourth correction value is equal to the sum of a first correction value calculated from the amount of the printing position shift produced by a first cause and a second correction value used in a rear end portion of the preceding set.

In this manner, in the present embodiment, the fourth correction value is calculated using any second correction value calculated in a preceding set. As described above, the fourth correction value used in correction for the printing position shift in the leading end portion may be calculated by different methods depending on whether a variation in the amount of conveyance per unit time is relatively large or small. Specifically, the behavior of a variation in the amount of conveyance per unit time occurring between sets because of kinds, sizes and the like of the print medium is acquired in advance, and a plurality of methods of calculation for the fourth correction value may be set relation to the behavior to allow selection of a calculation method meeting each of conditions.

<Continuous Printing Using Difference Kinds of Print Mediums>

Next, the case of using different kinds of print mediums in alternate order on a set basis will be described. In this case, the first correction value, the second correction value and the fourth correction value are stored in a memory on a kind-of-print-medium basis. In the present embodiment, the printing position shift in the leading end portion of a set using one kind of a print medium is corrected by use of the first correction value and the second correction value calculated from the amount of the printing position shift when the same kind of the print medium has been used the last time.

A description will be given of an example in which the print medium A (print mediums A1 to An) and the print medium B (print mediums B1 to Bn) are used in the order of print medium A1→print medium B1→print medium A2→print medium B2→ . . . →print medium An→print medium Bn for each set.

The printing position shift in the leading end portion of a set using the print medium A2 is corrected by use of the first correction value and the second correction value calculated from the amount of the printing position shift in the leading end portion of a set using the print medium A1. That is, a fourth correction value is calculated from the first correction value and the second correction value calculated from the amount of the printing position shift in the leading end portion of the set using the print medium A1. Then, this fourth correction value is used to correct the printing position shift in the leading end portion of the set of the print medium A2.

The printing position shift in the leading end portion of a set using the print medium B2 is corrected by use of the first correction value and the second correction value used in the rear end portion of a set using the print medium B1. That is, a fourth correction value is calculated from the first correction value and the second correction value used in the rear end portion of the set using the print medium B1. Then, this fourth correction value is used to correct the printing position shift in the leading end portion of the set of the print medium B2.

Through such correction, as shown in FIG. 12, even when the print medium A and the print medium B which differ in variation in the amount of the printing position shift are used in alternate order, using a correction value suitable for each kind of the print medium enables correction for the printing position shift.

In this manner, according to the present embodiment, even in the alternate use of different kinds of print mediums, the printing position shift occurred by a variation in the amount of conveyance of the print medium per unit time can be appropriately corrected to suppress deterioration in image quality.

Here, the case of storing a correction value in a memory for each kind of a print medium has been described. However, when a difference in variation in the amount of conveyance of the print medium is relatively small, a fourth correction value may be calculated as in the case of using the same kind of print mediums.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment (s) of the present invention, and by a method performed by the computer of the system or apparatus by, for example, reading out and executing the computer executable instructions from the storage medium to perform the functions of one or more of the above-described embodiment (s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-184303, filed Sep. 5, 2013, which is hereby incorporated by reference herein in its entirety.

What is claimed is:

1. A printing apparatus, comprising:

printing unit including a plurality of nozzle arrays with a plurality of nozzles for ejecting ink arranged therein in a predetermined direction, the plurality of nozzle arrays being arranged in a direction intersecting with the predetermined direction;

conveying unit configured to feed and convey print medium in a conveying direction intersecting with the predetermined direction;

print control unit configured to control the printing unit to use the plurality of nozzle arrays to print an image on the print medium conveyed by the conveying unit, and to cut the print medium with an image printed thereon from the print medium to output the cut print medium as one set;

correcting unit configured to determine, in printing an image on each of a plurality of sets of the same type of print medium, a correction value for correcting printing position shift between the plurality of nozzle arrays based on an inspection pattern printed on a preceding region of the print medium, and to correct the printing position between the plurality of nozzle arrays in the subsequent region of the print medium by using the determined correction value, wherein the correcting unit corrects, in printing on a leading end region of a set of print medium subsequent to the preceding set of print medium, the printing position shift by using the correction value used in printing on the preceding set of print medium.

2. The printing apparatus according to claim 1, wherein the correcting unit determines the correction values for each of a plurality of regions in each set of a print medium at different positions in the conveying direction and uses at least one of the correction values determined in the preceding set in the leading end region of the subsequent set.

3. The printing apparatus according to claim 1, wherein the correcting unit determines the correction values for each of a plurality of regions in each set of a print medium at different positions in the conveying direction and uses a correction value determined firstly in the preceding set in the leading end region of the subsequent set.

4. The printing apparatus according to claim 1, wherein the correcting unit determines the correction values for each of a plurality of regions in each set of a print medium at different positions in the conveying direction and uses a correction value determined lastly in the preceding set in the leading end region of the subsequent set.

5. The printing apparatus according to claim 1, wherein the correcting unit determines the correction values for each of a plurality of regions in each set of a print medium at different positions in the conveying direction and uses a mean value of the correction values determined in the preceding set in the leading end region of the subsequent set.

6. The printing apparatus according to claim 1, wherein the correcting unit determines the correction value used in the leading end region of the subsequent set according to at least one of conditions of a kind of the print medium, a size of the print medium and a state of a print surface of the print medium.

7. The printing apparatus according to claim 1, wherein the print control unit controls the printing unit to print the inspection pattern on a non-print region between continuous print regions of the print medium.

8. The printing apparatus according to claim 1, wherein the correcting unit corrects a printing position shift in a leading end region of the print medium of a second set by using a correction value for correcting a printing position shift occurring in a leading end region of the print medium of a first set preceding the second set, and the correcting unit corrects a printing position shift in a leading end region of the print medium of a third set subsequent to the second set by using a correction value for correcting a printing position shift occurring in a leading end region of the first set, and a correction value for correcting a printing position shift occurring in a leading end region of the second set.

9. The printing apparatus according to claim 1, wherein the correcting unit corrects a printing position shift in a leading end region of the print medium of a second set by using a correction value for correcting a printing position shift used in a rear end region of the print medium of a first set preceding the second set, and the correcting unit corrects a printing position shift in a leading end region of the print medium of a third set subsequent to the second set by using a correction value for correcting a printing position shift used in a rear end region of the first set, and a correction value for correcting a printing position shift used in a rear end region of the second set.

10. The printing apparatus according to claim 1, wherein the correcting unit allows adjustment data based on the correction value to be added to print data for printing the image, thereby correcting printing shift positions between the plurality of nozzle arrays.

11. The printing apparatus according to claim 1, wherein the print control unit controls the printing unit to print a maintenance pattern in accordance with input from a user, and the correcting unit determines a correction value for correcting the printing position between the plurality of nozzle arrays in the subsequent region of the print medium in accordance with a first correction value based on the printed maintenance pattern for correcting printing position shift between the plurality of nozzle arrays and a second correction value based on the inspection pattern printed on the preceding region.

12. A method for correcting the printing position shift in a printing apparatus which comprises printing unit including a plurality of nozzle arrays with a plurality of nozzles for ejecting ink arranged therein in a predetermined direction, the plurality of nozzle arrays being arranged in a direction intersecting with the predetermined direction, conveying unit configured to feed and convey print medium in a conveying direction intersecting with the predetermined direction, the method for correcting the printing position shift including the steps of:

controlling the printing unit to use the plurality of nozzle arrays to print an image on the print medium conveyed by the conveying unit, and to cut the print medium with an image printed thereon from the print medium to output the cut print medium as one set;

correcting printing position shift, to determine, in printing an image on each of a plurality of sets of the same type of print medium, a correction value for correcting printing position shift between the plurality of nozzle arrays based on an inspection pattern printed on a preceding region of the print medium, and to correct the printing position between the plurality of nozzle arrays in the subsequent region of the print medium by using the determined correction value, wherein in the step of correcting, in printing on a leading end region of a set of print medium subsequent to the preceding set of print medium, the printing position shift is corrected, by using the correction value used in printing on the preceding set of print medium.

13. The method for correcting the printing position shift according to claim 12, wherein in the step of correcting, the correction values for each of a plurality of regions in each set of a print medium at different positions in the conveying direction are determined and at least one of the correction values determined in the preceding set is used for the leading end region of the subsequent set.

14. The method for correcting the printing position shift according to claim 12, wherein in the step of correcting, the correction values for each of a plurality of regions in each set of a print medium at different positions in the conveying direction are determined and a correction value determined firstly in the preceding set is used for the leading end region of the subsequent set.

15. The method for correcting the printing position shift according to claim 12, wherein in the step of correcting, the correction values for each of a plurality of regions in each set of a print medium at different positions in the conveying direction are determined and a correction value determined lastly in the preceding set is used for in the leading end region of the subsequent set.

16. The method for correcting the printing position shift according to claim 12, wherein in the step of correcting, the correction values for each of a plurality of regions in each set of a print medium at different positions in the conveying direction are determined and a mean value of the correction values determined in the preceding set is used for the leading end region of the subsequent set.

17. The method for correcting the printing position shift according to claim 12, wherein in the step of correcting, the correction value used for the leading end region of the subsequent set is determined according to at least one of conditions of a kind of the print medium, a size of the print medium and a state of a print surface of the print medium.

18. The method for correcting the printing position shift according to claim 12, wherein in the step of controlling, the printing unit is controlled so as to print the inspection pattern on a non-print region between continuous print regions of the print medium.

19. The method for correcting the printing position shift according to claim 12, wherein in the step of correcting, a printing position shift in a leading end region of the print medium of a second set is corrected by using a correction value for correcting a printing position shift occurring in a leading end region of the print medium of a first set preceding the second set, and in the step of correcting a printing position shift in a leading end region of the print medium of a third set subsequent to the second set is corrected by using a correction value for correcting a printing position shift occurring in a leading end region of the first set, and a correction value for correcting a printing position shift occurring in a leading end region of the second set.

20. The method for correcting the printing position shift according to claim 12, wherein in the step of correcting, a printing position shift in a leading end region of the print medium of a second set is corrected by using a correction value for correcting a printing position shift used in a rear end region of the print medium of a first set preceding the second set, and in the step of correcting, a printing position shift in a leading end region of the print medium of a third set subsequent to the second set is corrected by using a correction value for correcting a printing position shift used in a rear end region of the first set, and a correction value for correcting a printing position shift used in a rear end region of the second set.

* * * * *